US006817403B2

(12) United States Patent
Hunter

(10) Patent No.: US 6,817,403 B2
(45) Date of Patent: Nov. 16, 2004

(54) MATCHPLATE MOLDING MACHINE FOR FORMING SAND MOLDS

(75) Inventor: William A. Hunter, Naples, FL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 0 days.

(21) Appl. No.: 10/443,329

(22) Filed: May 22, 2003

(65) Prior Publication Data

US 2003/0205349 A1 Nov. 6, 2003

Related U.S. Application Data

(62) Division of application No. 10/133,824, filed on Apr. 26, 2002, now Pat. No. 6,622,722.

(51) Int. Cl.[7] ..... B22C 15/00

(52) U.S. Cl. ..... 164/169; 164/183; 164/224; 164/181; 164/200; 164/201

(58) Field of Search ..... 164/19, 20, 21, 164/169, 183, 224, 181, 200, 201, 202

(56) References Cited

U.S. PATENT DOCUMENTS

| | | | |
|---|---|---|---|
| 3,406,738 | A | 10/1968 | Hunter |
| 3,506,058 | A | 4/1970 | Hunter |
| 3,520,348 | A | 7/1970 | Hunter |
| 3,807,483 | A | 4/1974 | Buhler |
| 3,827,549 | A | 8/1974 | Hunter |
| 4,156,450 | A | 5/1979 | Hunter |
| 4,437,507 | A | 3/1984 | Seeley |
| 4,463,794 | A | 8/1984 | Shioda |
| 4,589,467 | A | 5/1986 | Hunter |
| 4,590,982 | A | 5/1986 | Hunter |
| 4,657,064 | A | 4/1987 | Hunter |
| 4,699,199 | A | 10/1987 | Hunter |
| 4,738,299 | A | 4/1988 | Hunter |
| 4,840,218 | A | 6/1989 | Hunter |
| 4,848,440 | A | 7/1989 | Hunter |
| 4,890,664 | A | 1/1990 | Hunter |
| 5,022,512 | A | 6/1991 | Hunter |
| 5,069,268 | A | 12/1991 | Hunter |
| 5,101,881 | A | 4/1992 | Hunter |
| 5,148,851 | A | 9/1992 | Murata |
| 5,170,836 | A | 12/1992 | Hunter |
| 5,246,058 | A | 9/1993 | Murata |
| 5,343,928 | A | 9/1994 | Hunter |
| 5,547,015 | A | 8/1996 | Johansen |
| 5,853,042 | A | 12/1998 | Hunter |
| 5,901,774 | A | 5/1999 | Hunter et al. |
| 5,927,374 | A | 7/1999 | Hunter et al. |
| 5,971,059 | A | 10/1999 | Hunter et al. |
| 6,015,007 | A | 1/2000 | Hunter et al. |
| 6,145,577 | A | 11/2000 | Hunter et al. |
| 6,263,952 | B1 | 7/2001 | Hunter |

*Primary Examiner*—Len Tran
(74) *Attorney, Agent, or Firm*—Leydig, Voit & Mayer, Ltd.

(57) ABSTRACT

A method and automated matchplate molding machine for blowing sand horizontally into the horizontally spaced open ends of the cope and drag flasks with a perpendicular trajectory relative to a vertically aligned matchplate between the cope and drag flasks. Sand is pneumatically blown horizontally from sand magazines through opposing ends of the cope and drag flasks toward the matchplate. The cope and drag flask can be turned between the upright and rotated positions. The machine disassembles the mold flask and removes the mold in the upright position and fills the mold with sand horizontally when in the rotated position. The molding machine includes a rotating turret that carries two mold flasks between a mold forming station and a draw station. The mold flasks may also be rotated about a horizontal axis relative to the turret to facilitate turning of the mold flasks between upright and rotated positions.

31 Claims, 31 Drawing Sheets

MATCHPLATE MOLDING MACHINE FOR FORMING SAND MOLDS

CROSS-REFERENCE TO RELATED PATENT APPLICATION

This patent application is a divisional of U.S. patent application Ser. No. 10/133,824, filed Apr. 26, 2002 now U.S. Pat. No. 6,622,772.

FIELD OF THE INVENTION

This invention pertains to methods for forming sand molds, and specifically methods for forming sand molds utilizing a matchplate, a cope flask and a drag flask, and automatic matchplate molding machines for accomplishing the same.

BACKGROUND OF THE INVENTION

Foundries use automated matchplate molding machines to produce large quantities of green sand molds which in turn create metal castings. As is well known, sand molds typically comprise two halves, including a cope situated vertically on top of a drag. The cope and drag are separated by a horizontal parting line and define an internal cavity for the receipt of molten metal material. Often, sand cores may be placed in the internal cavity between the cope and the drag to modify the shape of metal castings produced by the sand molds. The cope mold has a pouring sprue to facilitate pouring of molten metal into the internal cavity of the mold. Once molten metal is received in a sand mold, it is allowed to cool and harden. Then, the sand mold can be broken apart to release the formed metal castings.

Although manual operations exist for creating sand molds, the modern way to form sand molds is through automated matchplate molding machines. Modern automated matchplate molding machines for creating sand molds are disclosed in the following patents to William A. Hunter, U.S. Pat. Nos. 5,022,512, 4,840,218 and 4,890,664, each entitled "Automatic Matchplate Molding System". These patents generally disclose the concept of using a flask assembly comprised of a drag flask, a cope flask, and a matchplate therebetween to form a sand mold. Like the cope and the drag of any ordinary sand mold, the cope flask is disposed vertically above the drag flask in these matchplate molding machines. As generally disclosed in these patents, the cope flask slides down upon the matchplate and the drag flask to assemble the flask assembly. Thereafter, sand magazines vertically above and below the flask assembly engage the vertically spaced open ends of the cope flask and the drag flask. Then sand in a fluid state is pneumatically blown into the cope and drag flasks. Thereafter, the flask is drawn apart to release the cope mold and the drag mold. The cope mold is then vertically spaced above the drag mold to allow for inspection of the patterned cavities formed into the molds and sometimes to allow for placement of sand cores in the drag mold such as with automatic core setting machines as shown for example in U.S. Pat. Nos. 4,590,982, and 4,848,440 to William A. Hunter. Then, the cope mold is lowered down upon on the drag mold to complete the sand mold. Although the general technique used in these machines has met with substantial commercial success, there are drawbacks. One drawback is that the machine must blow and squeeze sand vertically upward against the force of gravity into the lower drag mold.

The present inventor is aware of an attempt to introduce and blow sand through the rectangular sidewall of the cope and drag generally parallel to the matchplate rather than through vertically spaced open ends of the cope and drag. However, this creates a much more significant problem of "shadowing". Specifically, large projections on the pattern of the matchplate block and deflect the sand which can thereby create air pockets or cavities on the downstream side of the projection. Such air pockets or cavities are very undesirable as they cause molding problems in that molten metal may fill these cavities and thereby produce a faulty and misshapen metal casting.

As such, modern automatic matchplate molding machines still typically use the matchplate molding technology generally disclosed in the prior Hunter patents noted above.

BRIEF SUMMARY OF THE INVENTION

The present invention is directed towards a novel method of blowing sand into horizontally spaced open ends of the cope and drag flasks while the flask assembly is turned to a horizontal orientation (with the pattern plate extending vertically). The disclosed method utilizes a flask assembly comprised of a drag flask, a cope flask, and a matchplate. The matchplate has a pattern for forming a cavity in a sand mold and is sandwiched between the cope and drag flasks. The method comprises positioning the flask assembly with the pattern plate in a vertical orientation with the cope and drag flasks horizontally opposed on opposing sides of the pattern plate. The method also includes pneumatically conveying sand horizontally into the flask assembly in a fill direction which is perpendicular to the pattern plate to fill the cope flask and the drag flask with sand.

An embodiment of present invention is incorporated in an automated matchplate molding machine for accomplishing this method. The automated matchplate molding machine includes a pair of horizontally spaced sand magazines having blow heads adapted to fill the cope flask and the drag flask with sand. The sand magazines have a fill position wherein the flask assembly is horizontally sandwiched between the sand magazines. A vertically extending parting line is defined between the drag flask and the cope flask in the fill position, such that the flask assembly is oriented in a horizontally extending manner to facilitate blowing of sand into the mold flask horizontally through the ends of the cope flask and drag flask.

Several features and aspects of the present invention are also provided to achieve a practical and economically sensible automated matchplate molding machine. According to a preferred embodiment, the cope and drag flask made be turned between upright and tilted positions. The machine disassembles the mold flask and removes the mold in the upright position and fills the mold with sand horizontally when in the turned position. In the disclosed embodiment, a rotating turret carries two mold flasks between a mold forming station and a draw station whereat the mold flask is disassembled and a sand mold is removed. An actuator such as a hydraulic cylinder cyclically rotates the turret to switch the two mold flasks between the mold forming station and the draw station. The mold flasks may also be rotated about a horizontal axis relative to the turret to facilitate turning of the mold flasks between upright and rotated positions.

Other objectives, aspects, advantages and features of the present invention are set forth below or shown in the drawings attached hereto.

DETAILED DESCRIPTION OF THE PREFERRED EMBODIMENTS

The following examples further illustrate the invention but, of course, should not be construed as in any way limiting its scope.

Figure 24:
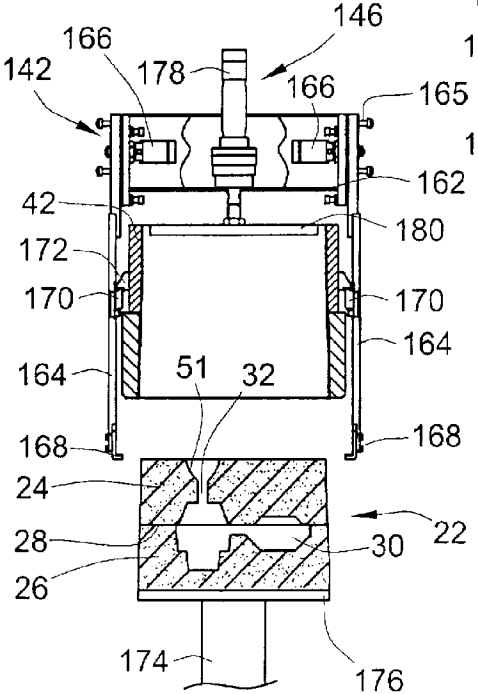

For purposes of illustration, an embodiment of the present invention is shown in the drawings as a matchplate molding machine 20 of the type used by foundries to form green sand molds 22 that in turn is used to create metal castings. As shown in FIG. 24, each overall mold 22 typically includes an upper cope mold 24 and a lower drag mold 26 abutting one another along a horizontal parting line 28. The cope mold 24 and the drag mold 26 define an internal cavity 30 of a particular shape into which molten metal is poured through a sprue 32 in the cope mold 24.

Figure 13:
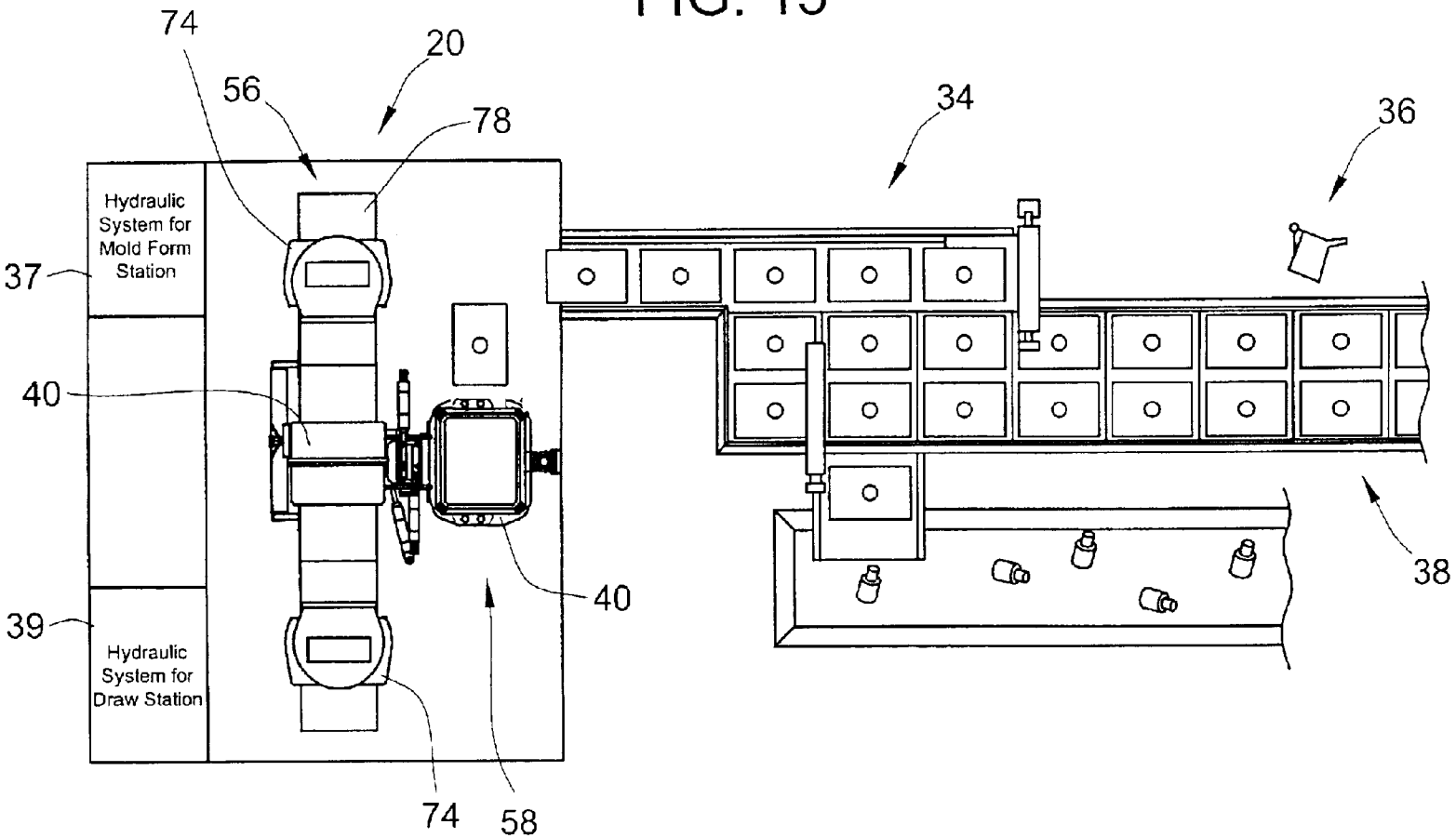
FIG. 13 is a schematic plan view of the matchplate molding machine shown in the previous Figures as installed in an overall mold making system.

Typically, the matchplate molding machine 20 will be used in conjunction with a downstream mold handling system 34 as shown schematically in FIG. 13. Many different forms of mold handling systems are known and can be used with the molding machine 20 such as those systems shown in U.S. Pat. Nos. 6,145, 5,901,774, 5,971,059, 5,927, 374 and 4,589,467 to William A. Hunter and/or William G. Hunter, or other appropriate mold handling system. In general, mold handling systems 34 include a pouring station 36 whereat molds are jacketed, weighted and molten metal is poured into the molds, and a cooling station 38 whereat the molten metal in the molds is allowed to cool and harden. Once the molds have cooled and the metal contained therein has sufficiently hardened, the molds are broken apart and the formed metal castings are harvested. FIG. 13 also illustrates that a hydraulic fluid power system may be mounted to the rear of the machine 20. In this embodiment, two separate hydraulic power systems 37, 39 are provided to provide separate hydraulic power to the forming station 56 and the draw station 58. Separate hydraulic systems 37, 39 provide more stable supply of hydraulic fluid to the two stations 56, 58.

Figure 39:
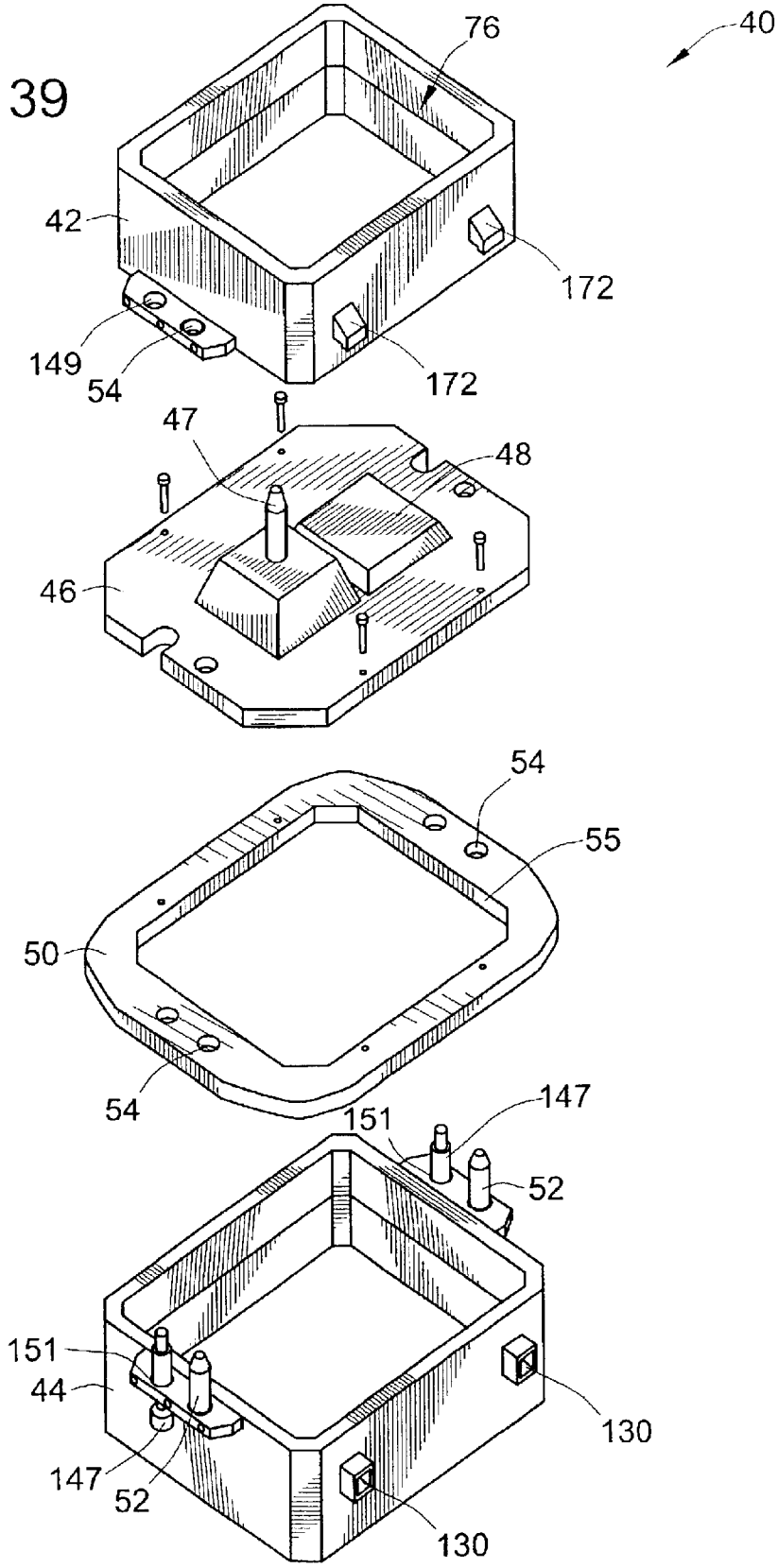
FIG. 39 is an exploded isometric assembly view of one of the mold flask assemblies of the matchplate molding machine shown in the previous Figures.
Figure 40:
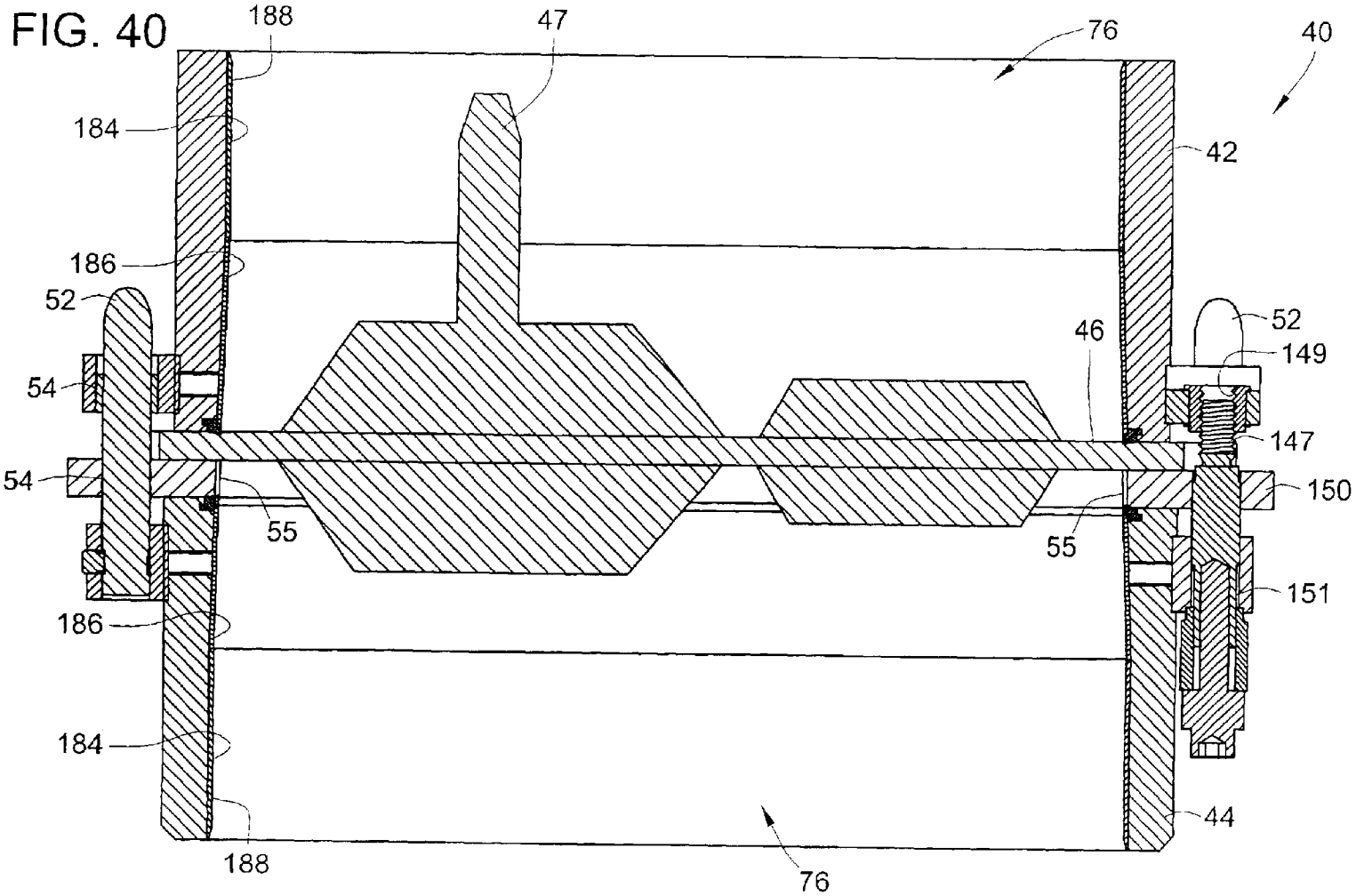
FIG. 40 is a cross section of one of the mold flask assemblies of the matchplate molding machine shown in the previous Figures.

To help gain an understanding of the mold making process, a mold flask assembly 40 for forming the mold 22 will first be described. As shown in FIGS. 39 and 40, the mold flask assembly 40 includes a cope flask 42 for forming the cope mold 24, a drag flask 44 for forming the drag mold 26 and a matchplate 46 sandwiched between the cope flask 42 and the drag flask 44. The matchplate 46 carries a pattern 48 that is adapted to form the internal cavity 30 between the cope and drag molds 24, 26. The pattern 46 includes a sprue former 47 that is received into a basin former 49 (FIGS. 10A and 10B) to form a pouring basin 51 and inlet sprue 32 in the sand mold 22 to provide an entrance for molten metal into the mold (See FIG. 24).

Referring to FIGS. 39 and 40, the flask assembly 40 may also include a support bolster 50 as shown in the disclosed embodiment to facilitate location of the matchplate 46 and mounting of the matchplate 46 to the drag flask 44. The support bolster 50 is a window frame like structure that includes a rectangular opening 55 that receives the matchplate 46 between cope and drag flasks 42, 44. The rectangular opening 55 of the support bolster 50 provides a hollow interior that exposes the top and bottom sides of the pattern 48 of the matchplate 46 to the interior chambers of the cope and drag flasks 42, 44. The drag flask 44 includes locating pins 52 on opposing sides that project toward the cope flask 42 and are received through locating holes 54 in the support bolster 50 and the cope flask 42 to provide for quick placement, removal and location of the bolster 50 and matchplate 46 between the cope and drag flasks 42, 44. As will be described in further detail below, the flask assembly 40 is assembled together when it is desired to form a mold 22 and disassembled or drawn apart when it is desired to release the mold 22 from the mold flask.

Figure 1:
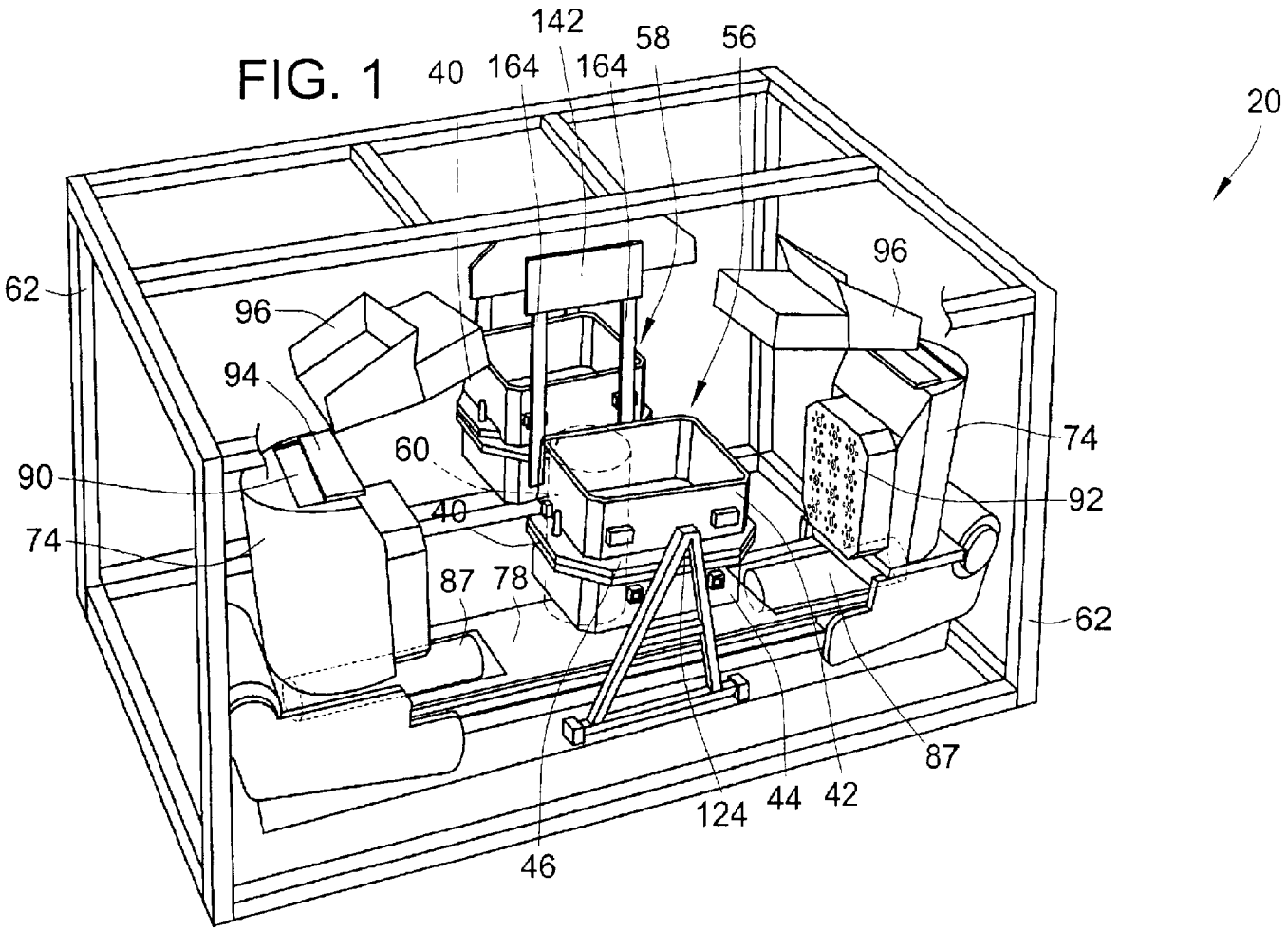
FIG. 1 is a rear perspective outline of a matchplate molding machine according to a preferred embodiment of the present invention.
Figure 2:
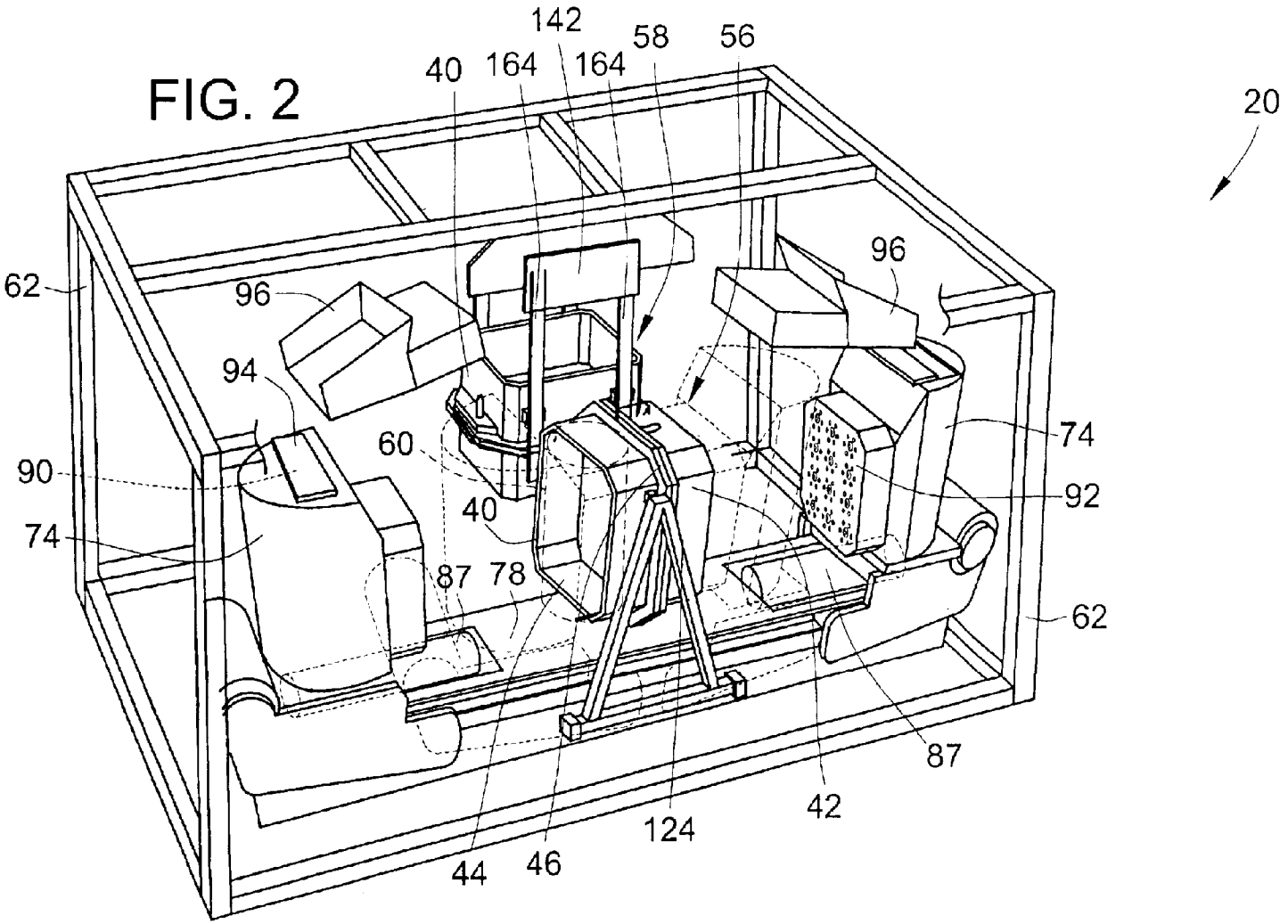
FIG. 2 is a similar perspective outline as FIG. 1, but with the mold flask at the mold forming station rotated, and dashed lines to illustrate movement of the sand magazines.

Referring to FIGS. 1 and 2, which illustrate perspective outlines of the molding machine 20 in two different states of operation, the matchplate molding machine 20 of the disclosed embodiment includes a mold forming station 56 for forming new sand molds and a draw station 58 for assembling mold flasks, disassembling mold flasks and releasing molds. In the disclosed embodiment, the mold forming station 56 is provided along the back half of the machine 20 while the draw station 58 is provided along the front half of the machine 20. Because two separate adjacent stations 56, 58 are provided, the disclosed embodiment of the matchplate molding machine 20 can use two mold flask assemblies 40, such that one mold flask assembly can be positioned at each different station for simultaneous operations occurring at each station 56, 58 to maximize sand mold making capacity and thereby provide for fast and practical production of sand molds 22. Although two flask assemblies 40 are shown, it will be appreciated that one flask assembly may be used or more flask assemblies may be used in alternative embodiments of the invention.

In the disclosed embodiment, the two mold flask assemblies 40 are carried on a turret 60 which rotates or swivels back and forth about a vertical axis to switch the mold flask assemblies 40 between the mold forming station 56 and the draw station 58. The turret 60 is shown in further detail in FIGS. 8, 9 and 11. As shown in these figures, the turret 60 is journalled or rotatably mounted to a fixed column or base 64 that extends upward from the primary support frame 62 of the matchplate molding machine 20. An actuator in the form of a hydraulic cylinder 68 rotates the turret 60 about the vertical axis. The hydraulic cylinder 68 has one end supported by through a support bracket mounted to the fixed column or base 64 and another end engaging the turret 60 at a point offset from the vertical rotational axis. Expansion and retraction of the cylinder 68 causes the turret 60 to cyclically index to switch the mold flasks 40 back and forth between the mold forming station 56 and the draw station 58. It is an advantage of the disclosed embodiment that a single actuator can quickly and simultaneously rotate the mold flasks 40 between the two stations 56 with a single indexing step through rotation of the turret 60.

Figure 8:
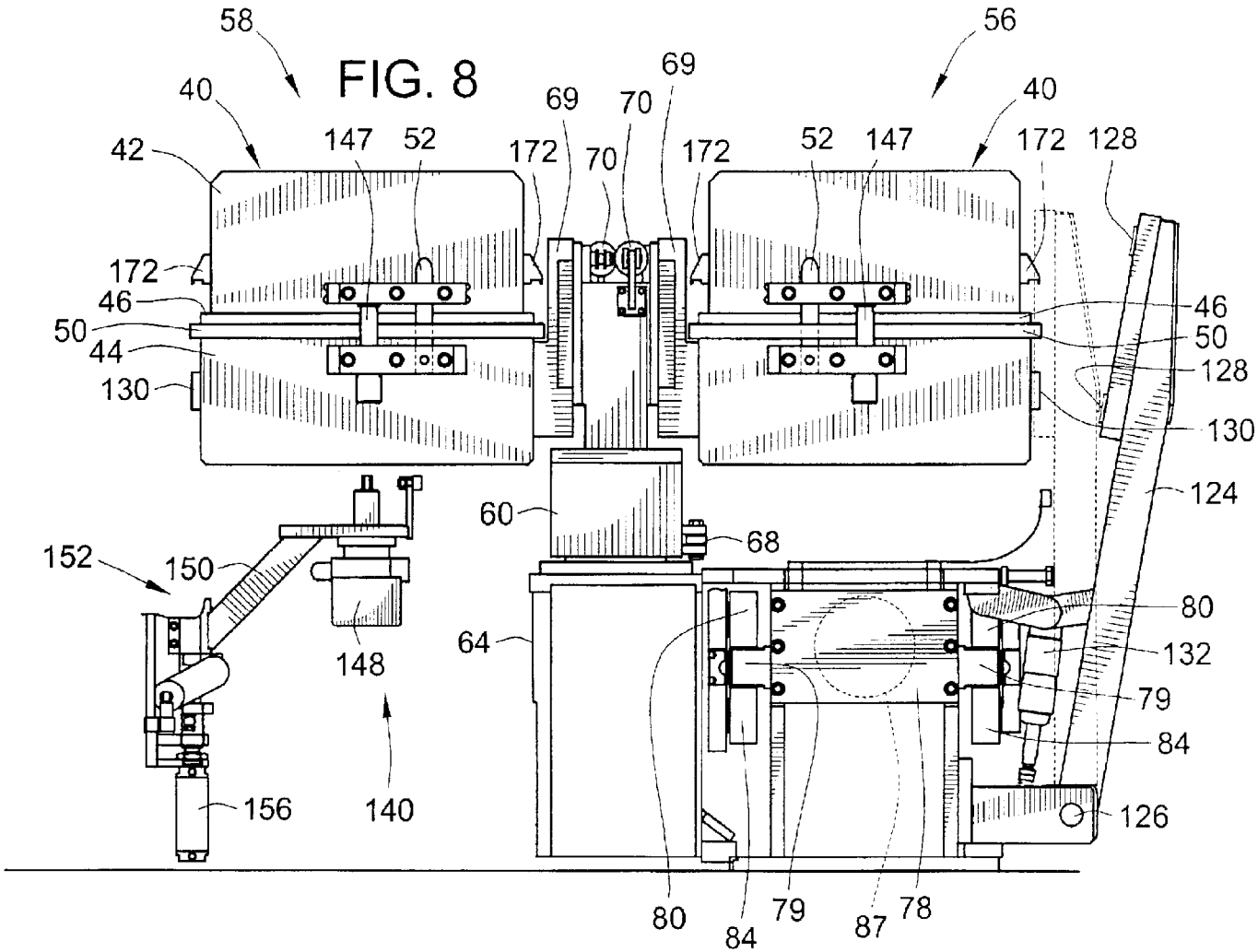
FIG. 8 is a subassembly side elevation view of the turret and flask assemblies of the matchplate molding machine shown in the previous Figures.
Figure 9:
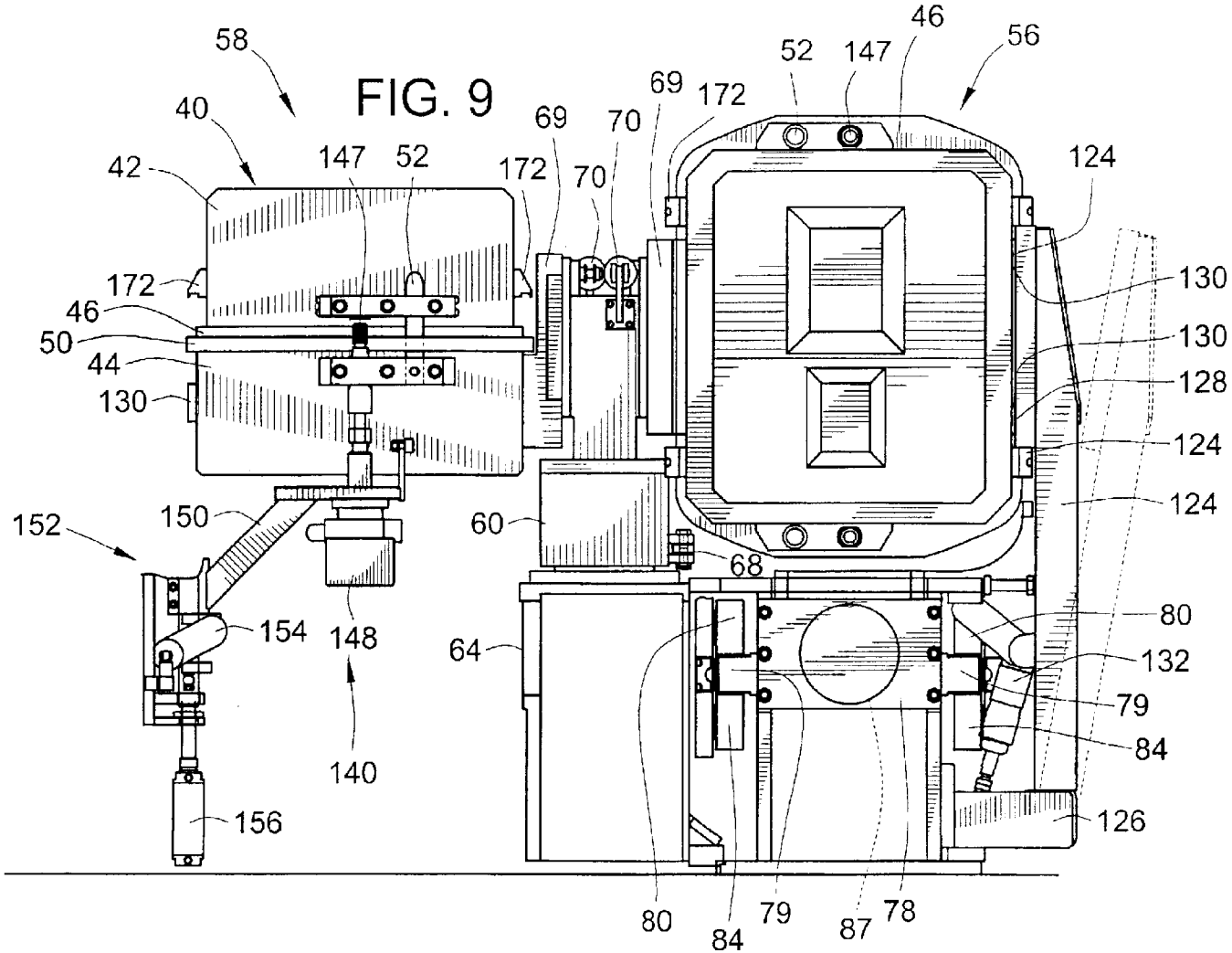
FIG. 9 is a similar view to FIG. 8 but with the mold flask assembly at the mold forming station rotated about a horizontal axis.

The mold flask assemblies 40 also rotate relative to the turret 60 about a horizontal axis, as can be seen when comparing FIGS. 1 and 2 or 8 and 9. In FIG. 8, the flask assembly 40 at the mold forming station is shown in an upright position with the matchplate 46 (e.g. the plane of the matchplate) oriented horizontally such that a horizontal parting line exists between the cope and drag flasks 42, 44. In FIG. 9, this flask assembly 40 has been turned to a turned position or fill position in which the matchplate 46 (e.g. the plane of the matchplate) is oriented vertically such that a vertical parting line exists between the cope and drag flasks 42, 44.

To facilitate turning of the flask assemblies 40 relative to the turret 60, the drag flask 44 of each flask assembly 40 is journalled or rotatably mounted to the turret 60 through a connecting arm 69. This connecting arm 69 projects horizontally outward from the turret 60 to support the drag flask in a cantilever manner and spaces the drag flask 44 from the turret 60. An actuator in the form of a hydraulic cylinder 70 (see also FIG. 11) rotates each flask assembly 40 about the horizontal axis. Each hydraulic cylinder 70 has first end supported by a support arm 72 that extends from and is mounted to the turret 60, and a second end acting upon the rotatable connecting arm 69 that supports the drag flask 44, such that expansion and contraction of the hydraulic cylinder 70 rotates the mold flask assembly 40 between upright and turned positions as shown in FIGS. 8 and 9.

Figure 4:
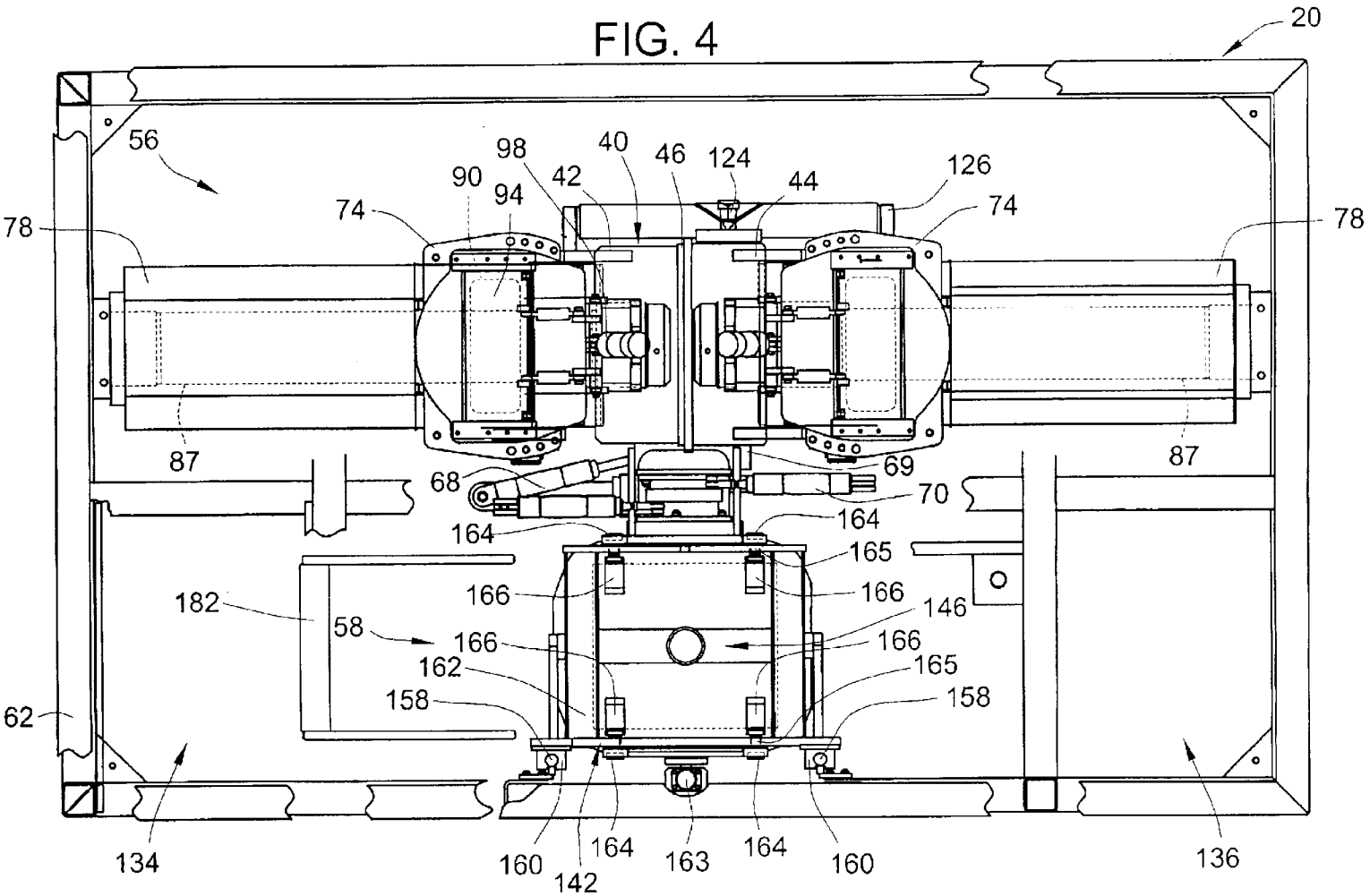
FIG. 4 is another plan view of the matchplate molding machine similar to FIG. 3 but with additional components being illustrated at the draw station and with the sand magazines being moved together.
Figure 33:
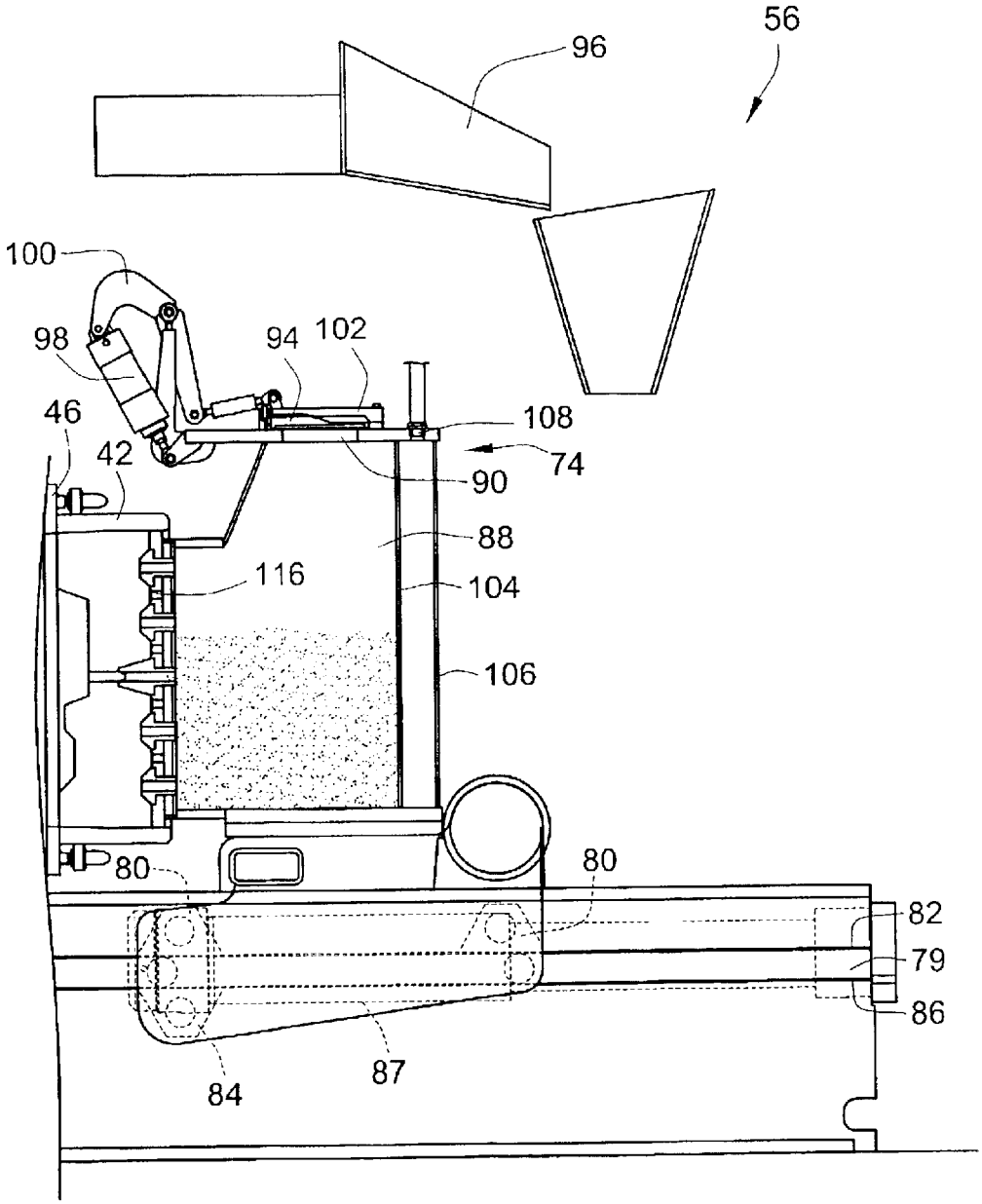
Figure 34:
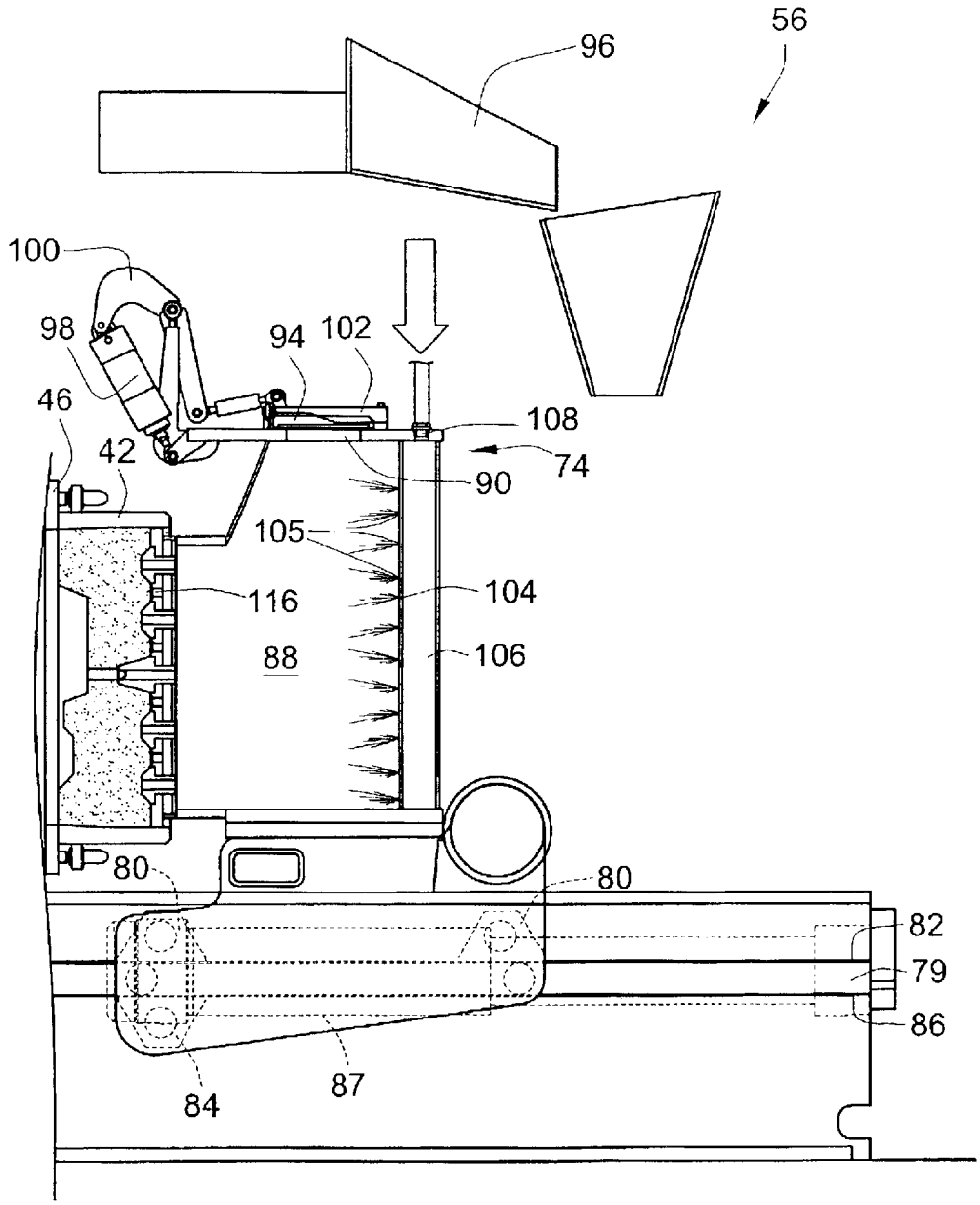

In accordance with the present invention, the disclosed embodiment blows sand into the cope and drag flasks 42, 44 while the mold flask assembly 40 is in the turned position shown in FIGS. 2, 4 and 34. When in this turned position, sand is pneumatically conveyed horizontally into the flask assembly 40 in a fill direction that is not only horizontal but also perpendicular to the matchplate 46 as schematically shown in FIGS. 33 and 34 to fill the cope and drag flasks 42, 44 with sand. By blowing the sand perpendicularly towards the matchplate 46, the disclosed method and matchplate molding machine 20 avoid the shadowing effect and thereby avoid the creation of undesirable air pockets in the resulting sand molds 22. The reason that shadowing is avoided is that the pattern 48 projects in a perpendicular manner from the matchplate 46 and therefore, sand is not deflected around the pattern and as such hidden downstream sides of the pattern 48 are eliminated or reduced to prevent creation of undesirable air pockets that could otherwise form.

Figure 3:
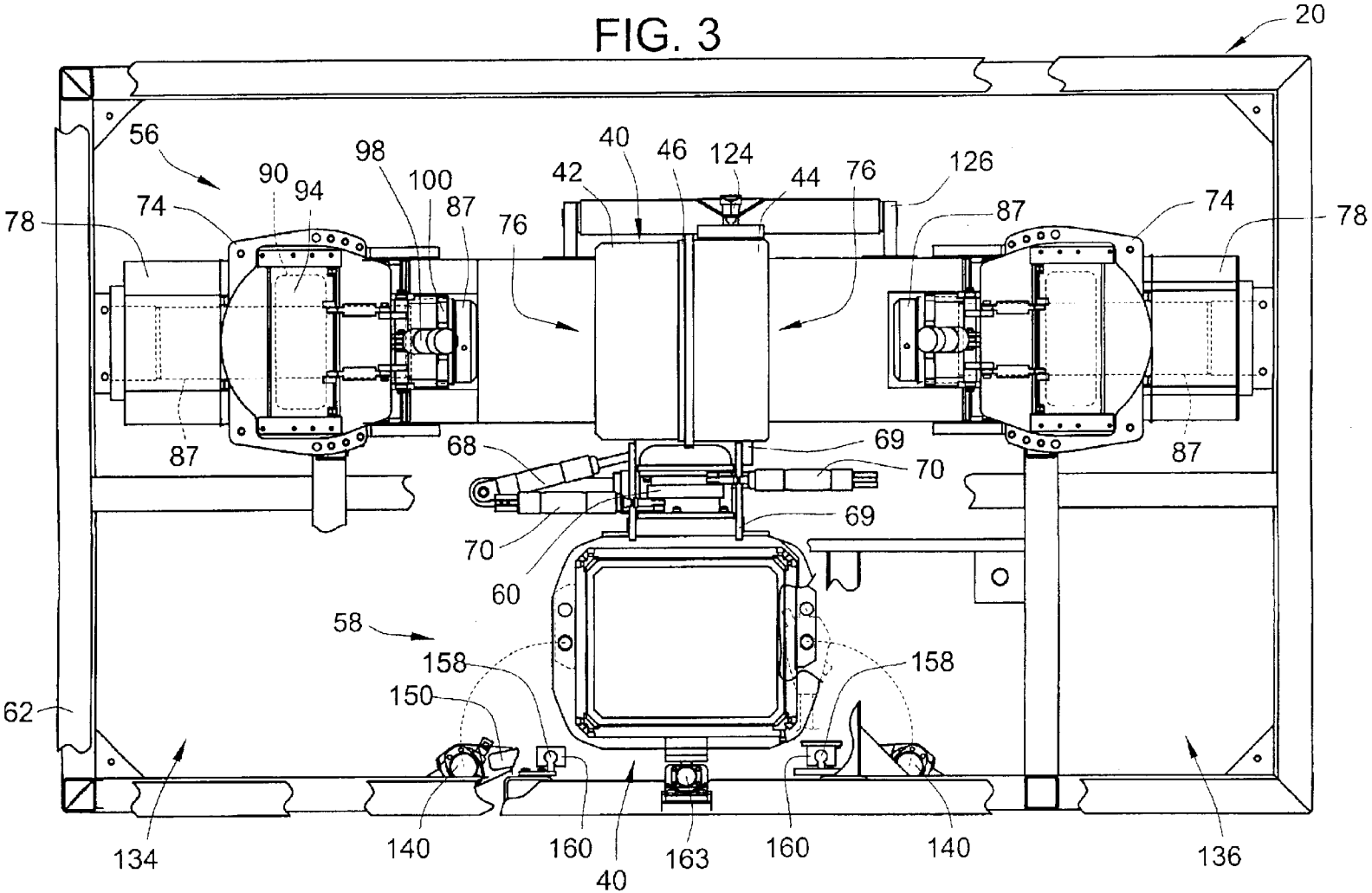
FIG. 3 is a plan view of the matchplate molding machine shown in the previous Figures with certain components removed to more clearly show certain aspects of the invention, with one mold flask in an upright position and the other in a turned position.
Figure 6:
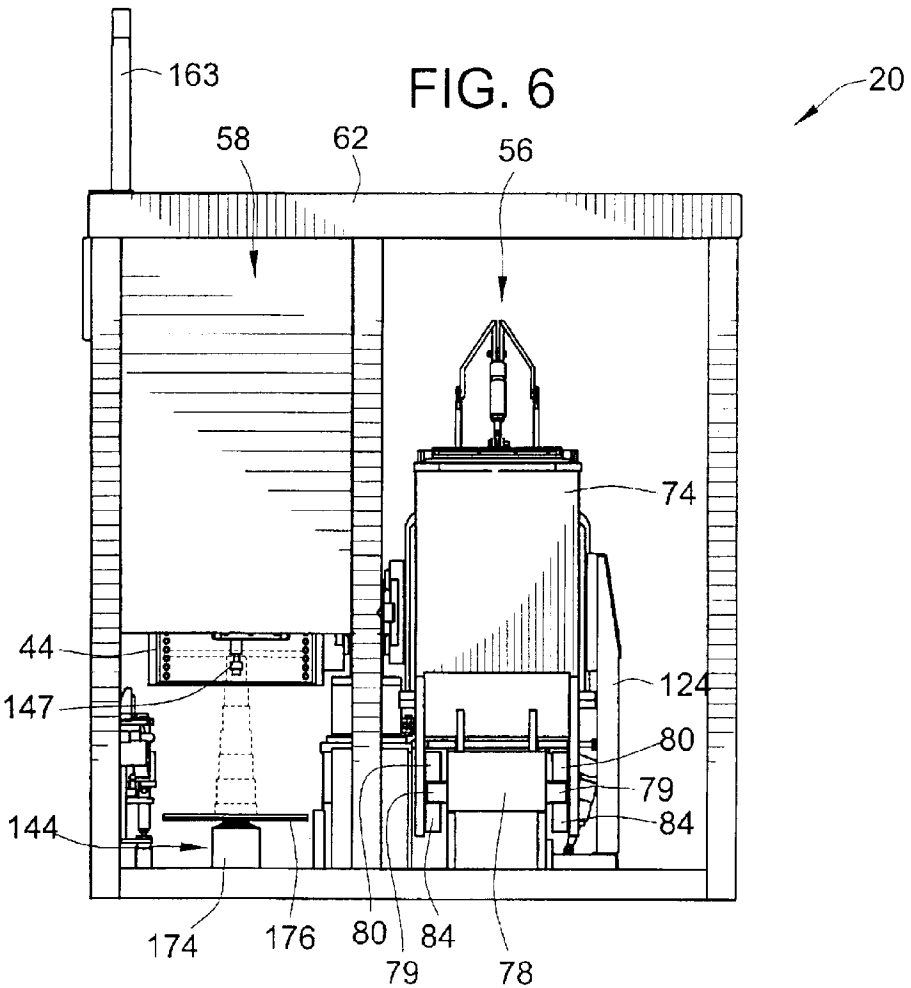
FIG. 6 is a right side elevation view of the matchplate molding machine shown in the previous Figures.
Figure 10A:
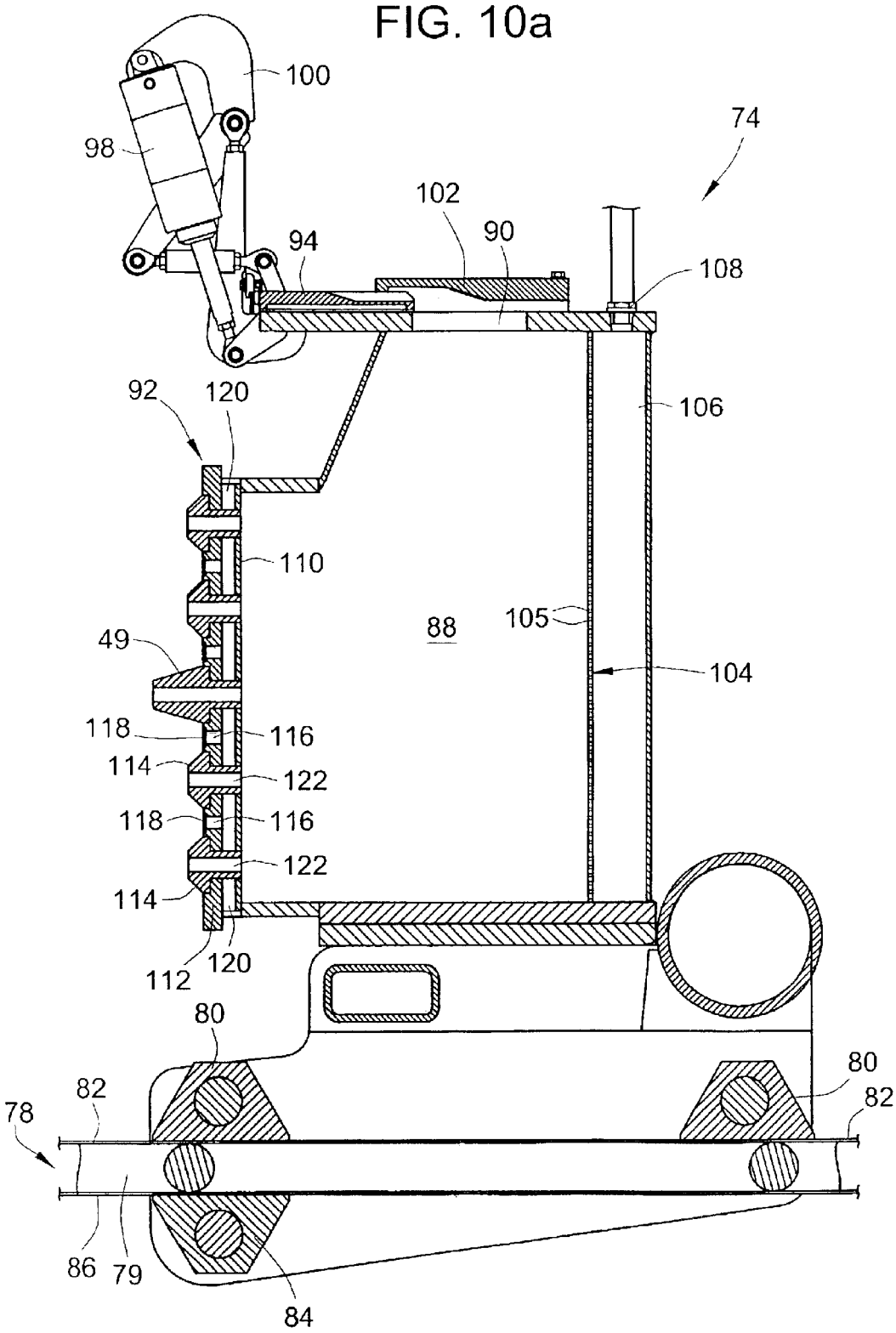
FIGS. 10A and 10B are partly fragmented cross sectional views of a sand magazine and track system used in the matchplate molding machine shown in the prior Figures.
Figure 10B:
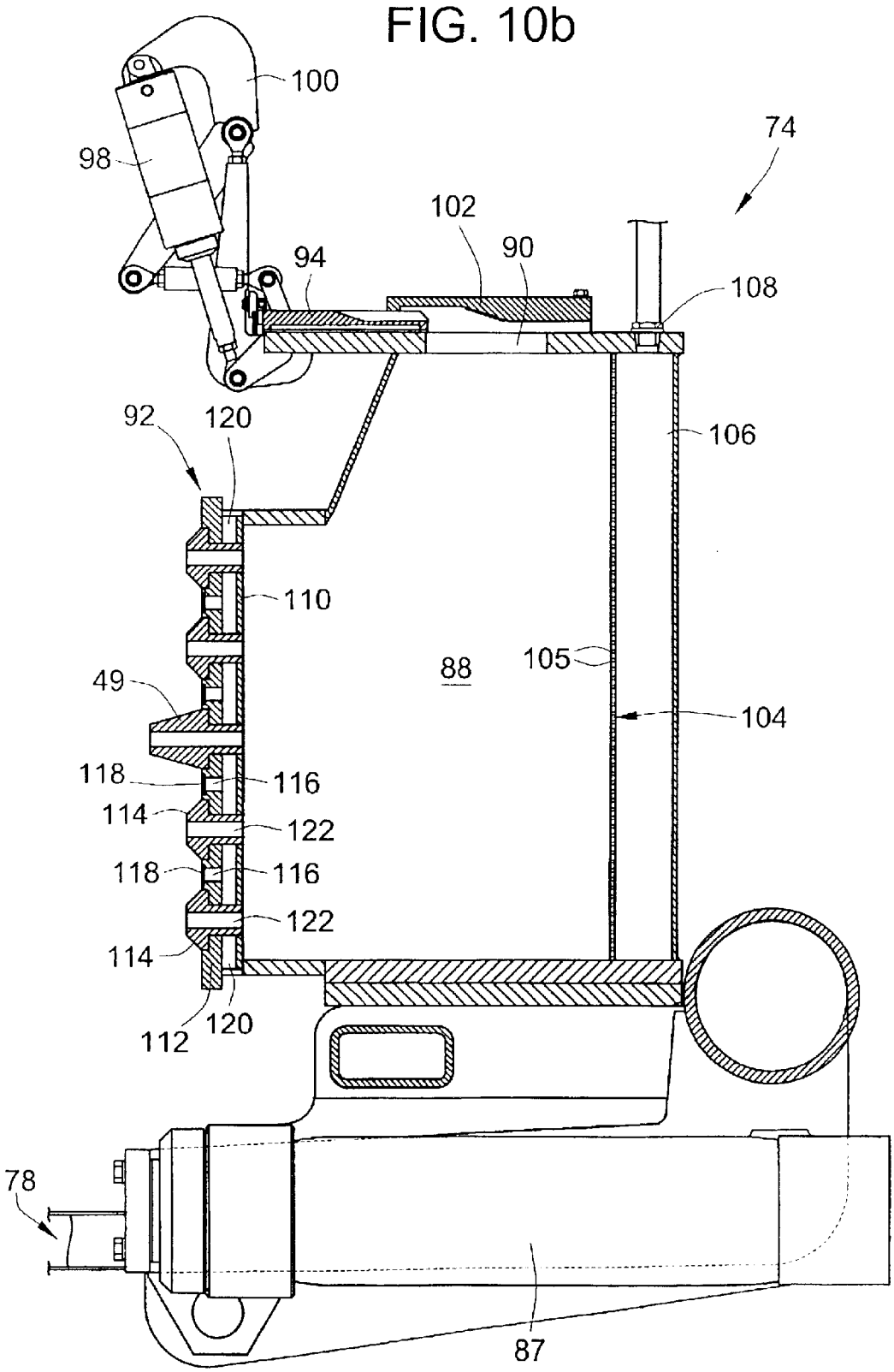

To accomplish horizontal blowing of sand along a perpendicular fill direction toward the matchplate 46, and referring to FIGS. 2–4, the disclosed embodiment of the matchplate molding machine 20 includes a pair of horizontally spaced sand magazines 74 that reciprocate horizontally toward and away from each other engage and disengage opposing open ends 76 of the flask assembly 40. Referring to FIGS. 10A and 10B, the sand magazines 74 slide and reciprocate linearly upon a horizontal steel frame track 78 that is mounted upon the main support frame 62. Each sand magazine 74 has upper slippers 80 that slide upon an upwardly facing surface 82 of the track 78 and lower slippers 84 that slide upon a downwardly facing surface 86 of the track 78. The upper slippers 80 carry the weight and vertical load of the sand magazines 74 while the lower slippers 84 are adapted to carry moment forces that occur when the squeezing of the sand mold takes place (see FIG. 35). To distribute the load and weight of each magazine, each sand magazine 74 includes at least two horizontally spaced upper slippers 80 and at least one lower slipper 84. To provide for lateral support of the sand magazines 74, pairs of the upper and lower slippers 80, 84 are provided on each lateral side of the track 78 to engage a pair of laterally spaced horizontal rails 79 on opposing sides of the track as can be seen when viewing the end of the track 78 as shown in FIG. 6.

With reference to FIGS. 3, 4 and 10B, each sand magazine 74 is driven by an actuator in the form of a hydraulic cylinder 87. Each hydraulic cylinder 87 is mounted centrally with the steel frame track 78 between the lateral spacing among the pairs of upper and lower slippers 80, 84. Each hydraulic cylinder 87 has one end supported by a lateral section of the steel frame track 78 and a second end engaging a bottom bracket portion of the sand magazine 74. Expansion and contraction of the hydraulic cylinders 87 linearly reciprocate the sand magazines 74 horizontally toward and away from each other along the track 78.

Figure 29:
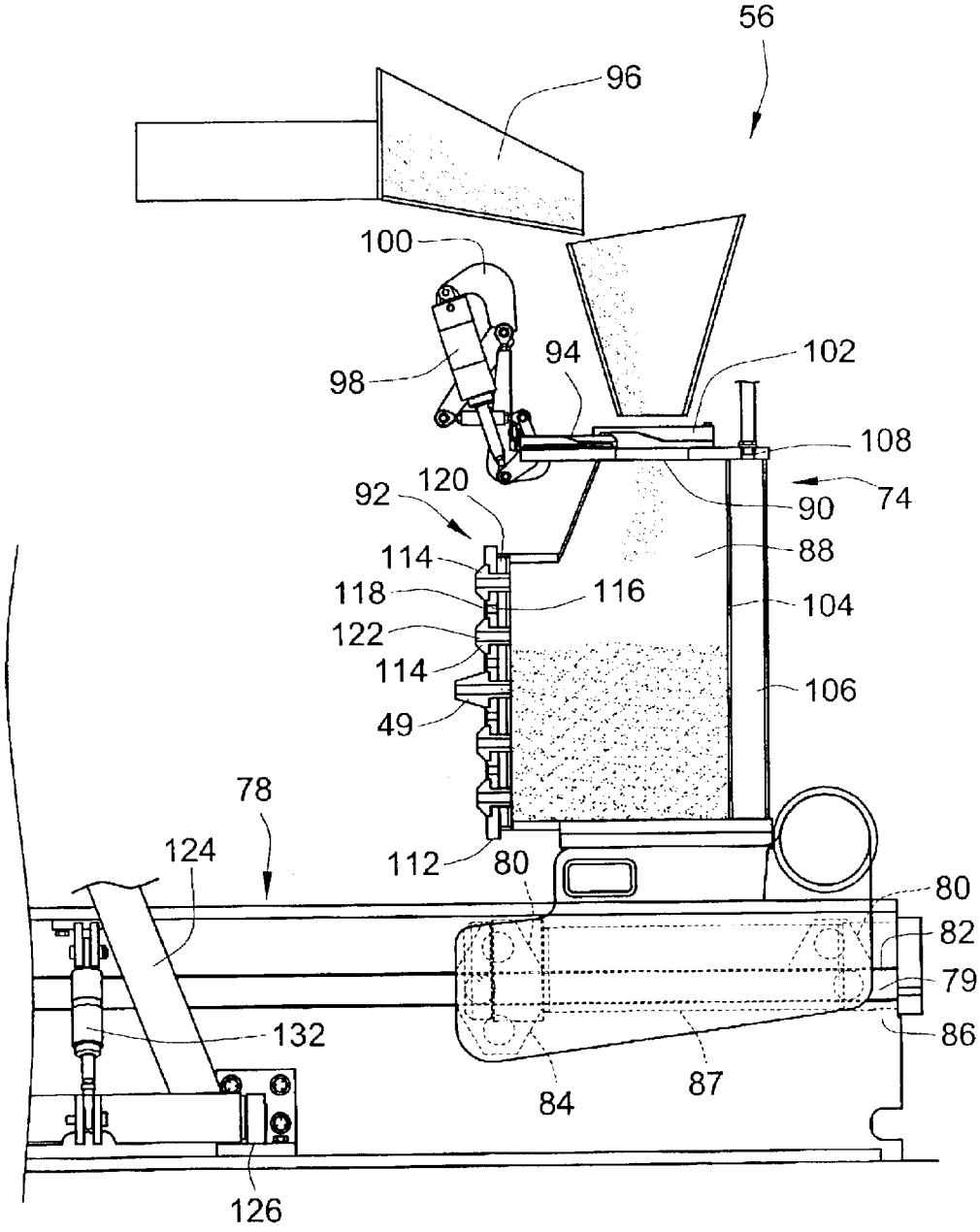
FIGS. 29–38 are partly schematic and partially cross sectioned rear elevation views of various components of the mold forming station of the matchplate molding machine shown in the previous Figures to illustrate the sequence of operations at the mold forming station.

Referring to FIGS. 10A and 10B, which show rear elevation and partially cross sectioned views of one of the sand magazines 74, each sand magazine 74 includes an internal reservoir 88 for holding sand that is interposed between a sand inlet port 90 and a blow head 92. The reservoir 88 is large enough to carry enough sand to fill and form one of the drag or cope molds. The magazine inlet port 90 is located at the top of the sand magazine 74 and aligns with the outlet of an overhead vibrating shuttle conveyor 96 when the sand magazines are fully retracted as shown in FIGS. 1 and 29. The vibrating shuttle conveyor 96 is mounted to the top of the support frame 62 and conveys sand from an overhead hopper (not shown) to the sand magazine 74 to reload the magazine with sand. A gate 94 is slidably mounted to the top of the sand magazine 74 to open and close the inlet port 90 as shown in FIGS. 10A and 10B. A pneumatic or hydraulic cylinder 98 carried by the sand magazine 74 acts upon the gate 94 through a lever or mechanical linkage 100 to open and close the gate 94. The gate 94 slides in a guide track 102 that is securely mounted along the top surface of the sand magazine 74. The guide track 102 provides vertical support to urge the gate 94 against the top surface of the sand magazine 74 when the gate 94 is closed to provide a sufficient seal that allows the sand magazine to be pressurized for blowing operations and to prevent escape of sand. Each sand magazine 74 also includes a baffle plate 104 contained inside the hollow interior of the sand magazine to partition the sand reservoir 88 from a pneumatic charge chamber 106. The baffle plate 104 is perforated and includes multiple small openings 105 to allow for the passage of air therethrough while generally preventing the backflow of sand into the charge chamber 106 while the magazine is being reloaded or refilled with sand. The pneumatic charge chamber 106 has an inlet port coupling 108 that is adapted to connect to a high pressure compressed air source in order to pressurize the sand magazine 74 for pneumatic sand blowing operations.

The blowheads 92 of the opposing sand magazines 74 face each other and are horizontally opposed. Each blowhead 92 comprises a rectangular squeeze board 112 that slides closely into one of the open ends 76 of the mold flask assembly 40. As shown in the figures, the squeeze board 112 lies in a vertical plane and is spaced horizontally from the endplate 110 of the sand magazine 74. The squeeze board 112 is perforated and includes a plurality of nozzles 114 that are mounted through the squeeze board 112 and through the endplate 110 to fluidically connect with the sand reservoir 88 contained within each sand magazine 74. The squeeze board 112 also includes a plurality of vents 116 about the nozzles 114 that are adapted to exhaust air from the flask assembly 40 to the planar air exhaust gap 120 between the end plate 110 and blowhead 92. The vents 116 contain steel screens 118 to prevent passage of sand through the vents 116. The nozzles 114 are spaced laterally and vertically over the squeeze board 112 and are pointed perpendicularly towards the matchplate 46 during engagement with the open end 76 of one of the flask assemblies 40. During pneumatic sand blowing operations, the nozzles 114 direct sand at a perpendicular trajectory to the matchplate 46 as shown schematically in comparing FIGS. 33 and 34. The squeeze board 112 for the cope flask 42 also includes the basin former 49 that coacts with the sprue former 47 that extends perpendicularly from the matchplate 46 for forming the resulting basin and inlet sprue in sand molds.

Each nozzle 114 defines an internal horizontal passage 122 that is connected to the sand reservoir 88. With the disclosed embodiment, this horizontal passage 122 does not need to be cyclically opened and closed by a gate, but can be continuously open during sand filling and molding operations due to the horizontal orientation of the nozzles 114. Specifically, each horizontal passage 122 has a small enough diameter and a long enough horizontal length to prevent sand from spilling out the nozzle 114 under the force of gravity when the sand magazine 74 is being reloaded with sand through the inlet port 90 and when the sand magazine 74 is sitting idle full of sand or moving towards a positioned flask assembly 40.

Figure 7:
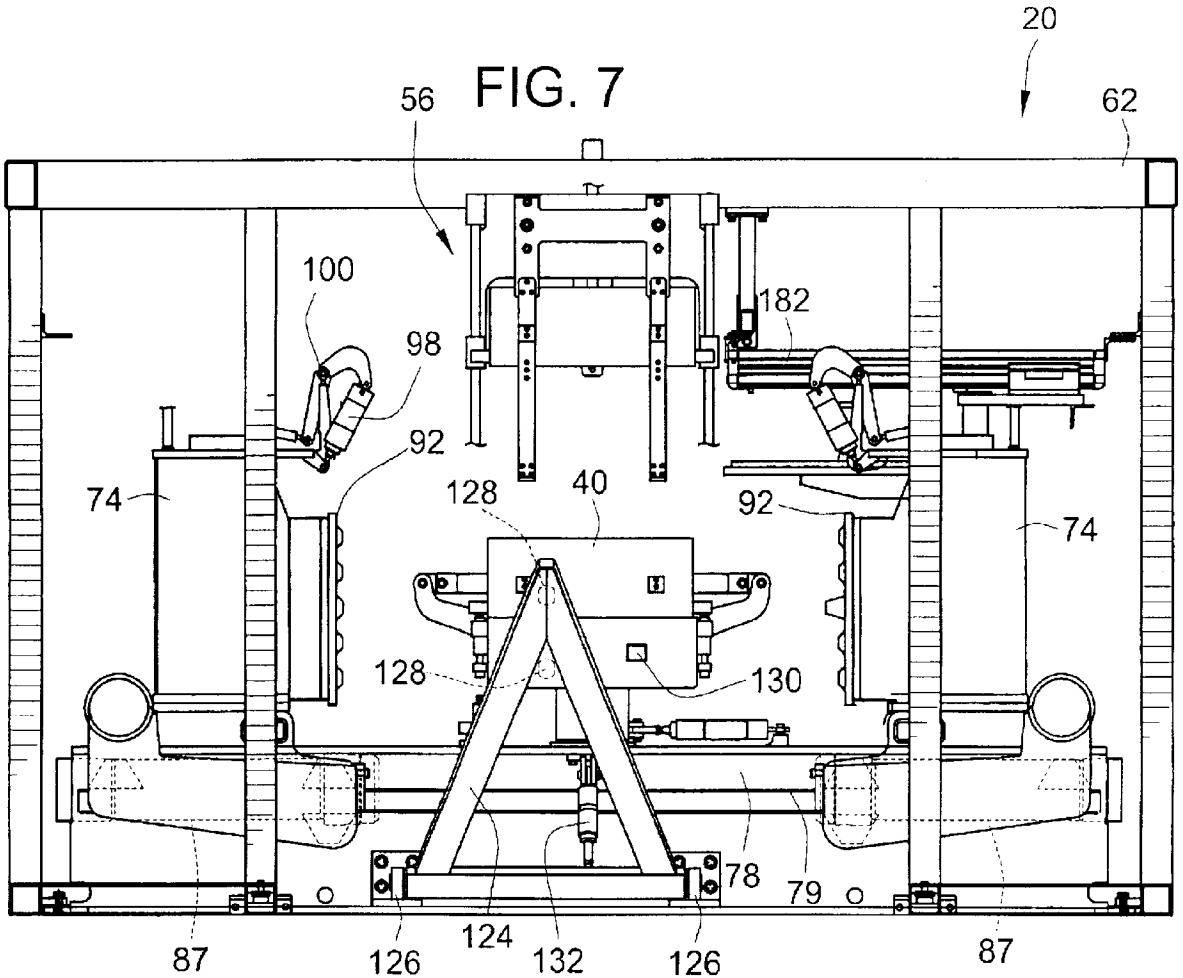
FIG. 7 is a rear elevation view of the matchplate molding machine shown in the previous Figures.

As shown in FIGS. 7–9, the mold forming station 56 also includes a support brace 124 that comprises an A-frame structure pivotably connected to the main support frame 62 of the machine 20 at a hinge 126. The support brace 124 includes one or more locking tabs 128 towards the top of the A-frame structure that are adapted to slide into and engage recesses 130 provided in formed bosses projecting along the side of the drag flask 40. An actuator shown in the form of a hydraulic cylinder 132 is adapted to pivot the support brace 124 between disengaged and engaged positions as shown in FIGS. 8 and 9, respectively. The hydraulic cylinder 132 has one end supported by the main support frame 62 of the machine and a second end action upon the brace 124 at a location offset from the hinge 126 such that linear expansion and contraction of the hydraulic cylinder 132 pivots the support brace 124 between engaged and disengaged positions. The support brace 124 serves the function of supporting the drag flask 44 when the sand magazines 74 are being driven towards each other to squeeze sand in the mold flask assembly 40. Each flask assembly 40 is normally supported in a cantilever manner by the turret 60 through the connecting arm 69. However, when the support brace 124 is engaging the opposing side of the drag flask 44, the locking tab 128 horizontally engages the drag flask recess 130 to carry horizontal loads through the support brace 124 to the main frame 62 and thereby eliminate or greatly reduce moment loads that may be applied to the turret 60 if and when the sand magazines 74 impart uneven horizontal forces during blowing and squeeze operations.

Figure 5:
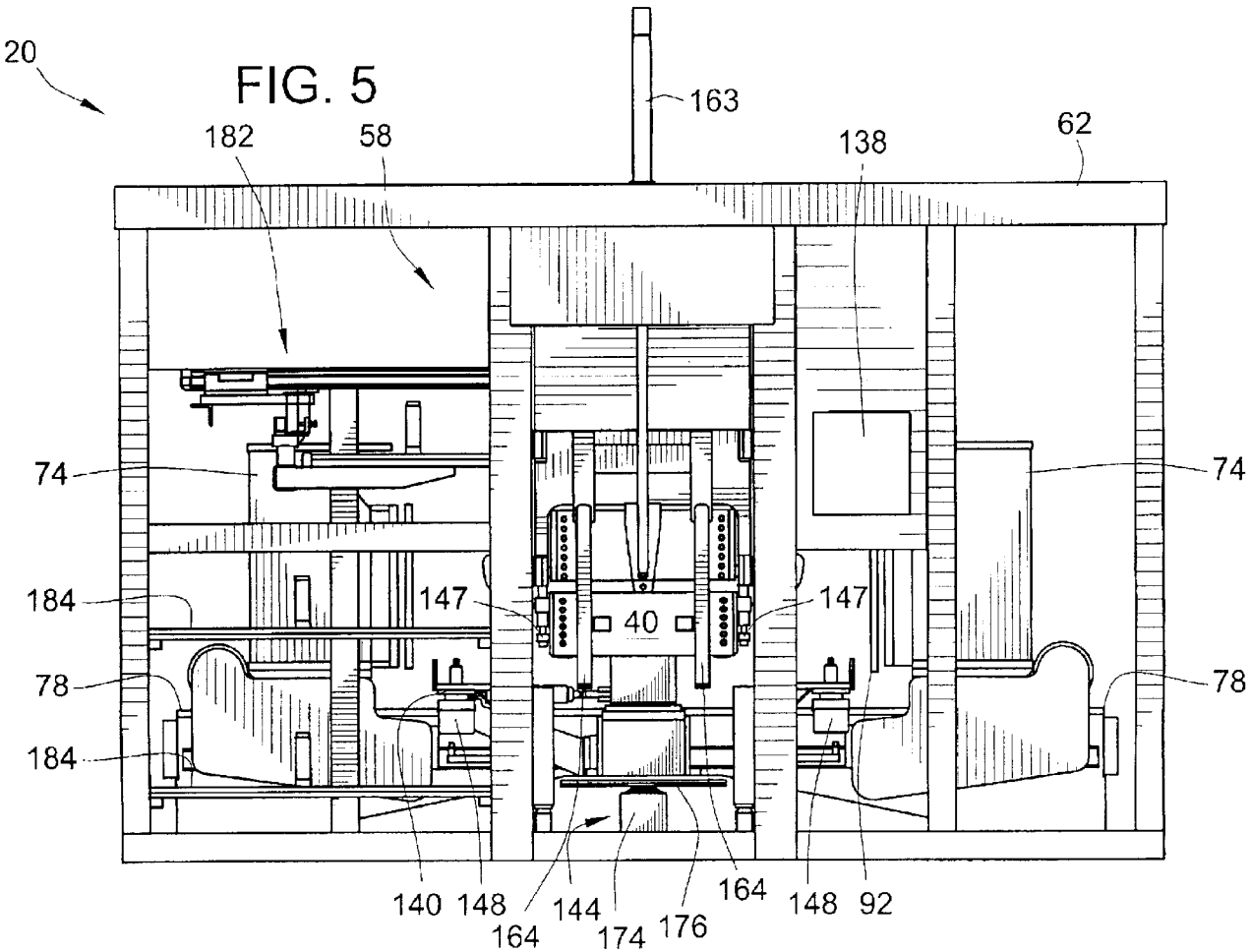
FIG. 5 is a front elevation view of the matchplate molding machine shown in the previous Figures.

Referring now to the draw station 58 on the front side of the machine 20, and with reference to FIGS. 3–5, the front of the machine 20 provides the draw station 58 horizontally between a matchplate storage receptacle 134 and an output station 136 whereat an output conveyor (not shown) is received to transfer sand molds for subsequent pouring and cooling operations. The front of the machine 20 also includes an operator input module 138 that is adapted to receive manual input instructions from the machine's operator to control the various operations of the machine 20.

Figure 11:
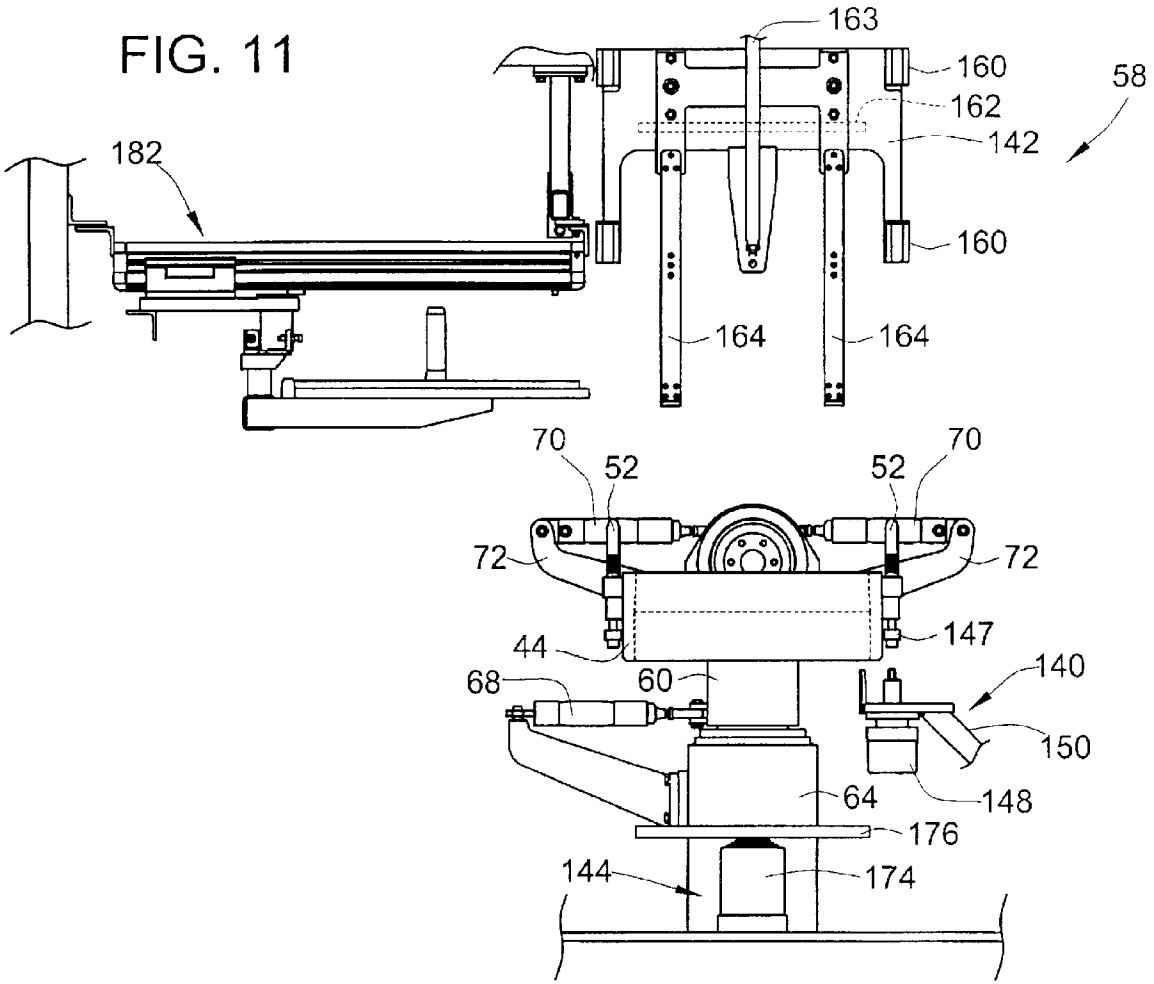
FIG. 11 is a subassembly front elevation view of various components of the draw station of the matchplate molding machine shown in the previous Figures.
Figure 12:
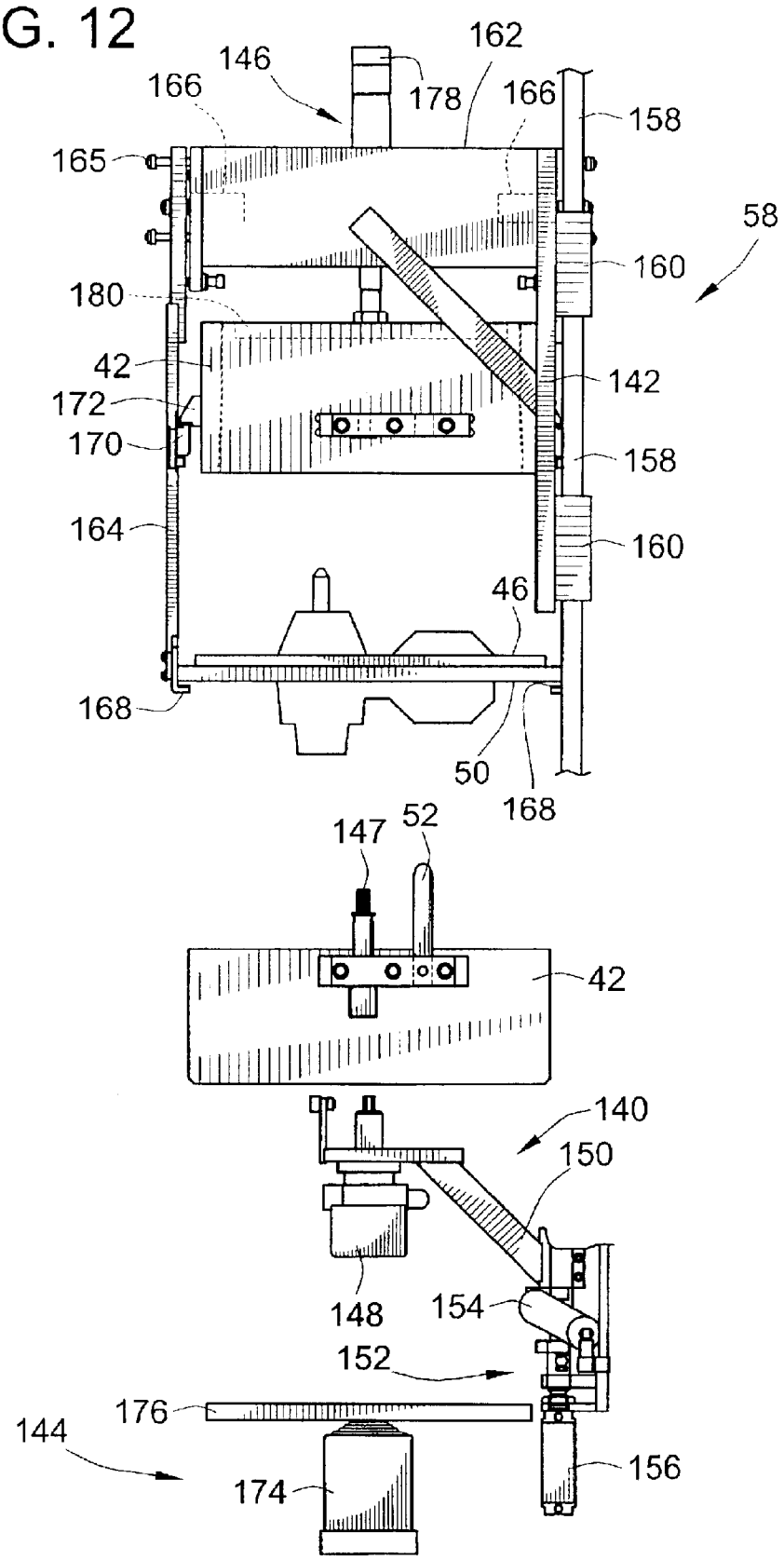
FIG. 12 is a subassembly side elevation of various components of the draw station of the matchplate molding machine shown in the previous Figures.

The draw station 58 includes several different systems or components to facilitate disassembly of mold flask assemblies 40, removal of sand molds 22, and reassembly of mold flask assemblies 40. These systems or components include a clamping mechanism 140, a draw carriage 142, a lower hydraulic ram 144, and an upper hydraulic ram 146, as shown in FIGS. 11 and 12.

The clamping mechanism 140 includes a pair of power driven screwdrivers 148 for screwing and unscrewing clamping screws 147 that extend through holes in the bolster and matchplate, and that thread into diametrically opposed threaded holes 149, 151 in the cope and drag flasks 42, 44 (the hole 149 in the cope flask 42 being threaded). The screw 147 is a form of clamp that serves the purpose of clamping the cope and drag flasks 42, 44 together such that when the flask assembly is rotated or in the turned position as shown in FIG. 4, the cope flask 42 remains securely clamped to the drag flask 44 with the bolster and matchplate sandwiched therebetween.

Each screwdriver 148 is carried upon a pivoting swing arm 150. The swing arm 150 is pivotably mounted to the main support frame 62 at hinge 152. An actuator in the form of a hydraulic or pneumatic cylinder 154 pivots the swing arm 150 and screwdriver 148. The screwdriver 148 also slides vertically relative to the swing arm 150 and is vertically actuated with a second hydraulic or pneumatic cylinder 156. The first cylinder 154 has one end pivotably connected to the main support frame 62 for support and second end acting upon the swing arm 150 such that expansion and contraction of the first cylinder 154 causes the swing arm 150 and screwdriver 148 to swing into position for actuating the screw 147 and out of position to provide clearance for flask movement. The second cylinder 156 has one end supported by the swing arm 150 and another end acting upon the screwdriver 148 such that expansion and contraction of the cylinder 156 raises and lowers the screwdriver 148.

Figure 16:
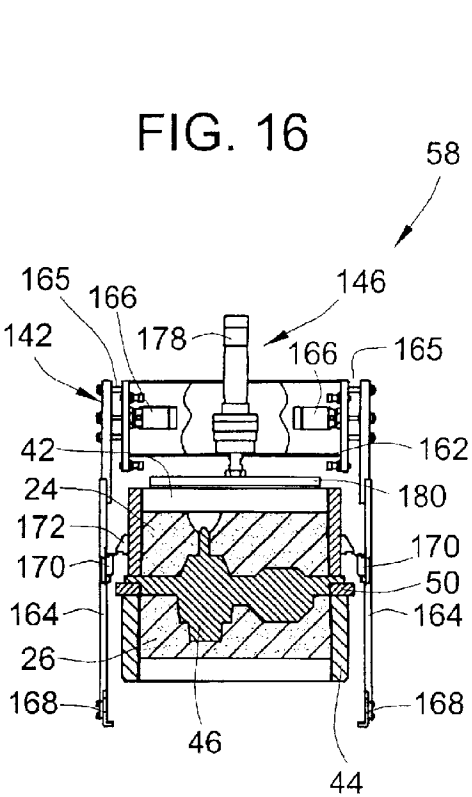
FIGS. 14–28 are partly schematic and partially cross sectioned side elevation views of various components of the draw station of the matchplate molding machine shown in the previous Figures to illustrate the sequence of operations at the draw station.
Figure 17:
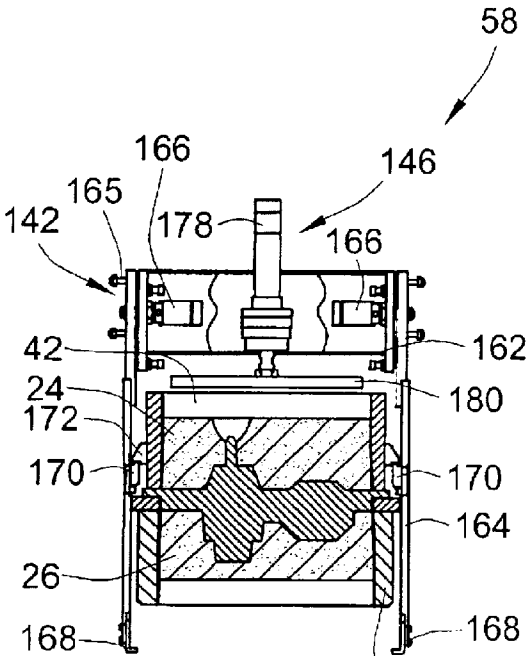

The draw carriage 142 slides vertically upwardly and downwardly through a linear slide assembly that includes a pair of vertical rails 158 mounted to the main support frame 62 and linear bearings 160 sliding vertically upon the rails 158. The linear bearings 160 support a frame including a horizontally extending platform 162. The draw carriage 142 is actuated by means of a hydraulic or pneumatic cylinder 163 that has one end supported by the main support frame 62 and another end acting upon the carriage platform 162. The carriage platform 162 carries a plurality of draw hooks 164 including front and rear pairs of the draw hooks 164. The draw hooks 164 are supported through lateral slide assemblies 165 mounted on the top side of the carriage platform 162 such that the draw hooks 164 slide laterally relatively to the platform 162 forwardly and rearwardly as shown in FIGS. 16 and 17. Pneumatic cylinders 166 mounted to the platform 162 drive the front and rear pairs of draw hooks 165 toward and away from each other as shown in FIGS. 4 and 12. Each of the draw hooks 164 have inwardly bent lower ends to provide lift tabs 168 that are adapted to engage and support the bottom surface of the support bolster 50 and/or matchplate 56. The draw hooks 164 also include projecting lift detents 170 intermediate along the vertical length of the draw hooks 164 to provide a structure for engaging corresponding detents 172 that project laterally forward and rearward on the front and rear sides of the cope flask 42.

Referring to FIGS. 11 and 12, the draw station 58 also includes vertically spaced rams 144, 146 disposed above and below each mold flask assembly 40 when positioned at the draw station 58. The lower ram 144 includes a telescoping hydraulic cylinder 174 supported upon the main frame 62 that carries a mold base platform 176. The mold base platform 176 is adapted to receive a fully formed mold 22 and lower the mold 22 out of the drag flask 44 to a lower elevation for removal on an output conveyor (not shown) through the mold output station 136. The upper ram 146 includes a hydraulic cylinder 178 supported by the draw carriage platform 162 and has a push plate 180 at its end that is adapted to push out sand mold elements from the mold flask assemblies 40.

Also preferably provided at the draw station 58 is a suspension assist system 182. The suspension assist system 182 is mounted to the main support frame 62 and is movable vertically, horizontally and laterally about to support the bottom surface of the bolster 50 and carry the vertical gravitational loads of bolsters 50 and matchplates 46 to facilitate removal of matchplates 46, placement of matchplates 46 in the storage receptacle 134, and placement of matchplates on the draw hooks.

Now that the structures and structural relationships of various systems and components of the machine have been set forth above, the operation of the disclosed embodiment will now be discussed. It will be understood and readily appreciated by one skilled in the art that the sequence of operation can be manually controlled using the operator input module 38 or use of electronic controllers (e.g. microprocessors or programmable logic controllers) that are responsive proximity sensors, position sensors or other suitable sensors (sensors not being shown) to indicate the position of various components and/or completion of various sequential steps and thereby automatically continue to the next sequential step or any combination of manual and automated controls. As noted above, simultaneous and separate operations can occur at the draw station 58 and the mold forming station 56 for the two different mold flask assemblies 40 that are provided. Each of the operations performed at these stations 56, 58 are independent of one another and as such are independently shown in schematically illustrated sequential steps in FIGS. 14–28 for the mold forming station 56 and FIGS. 29–38 for the draw station 58. The sequence of operation at these two stations will be addressed separately below.

Figure 30:
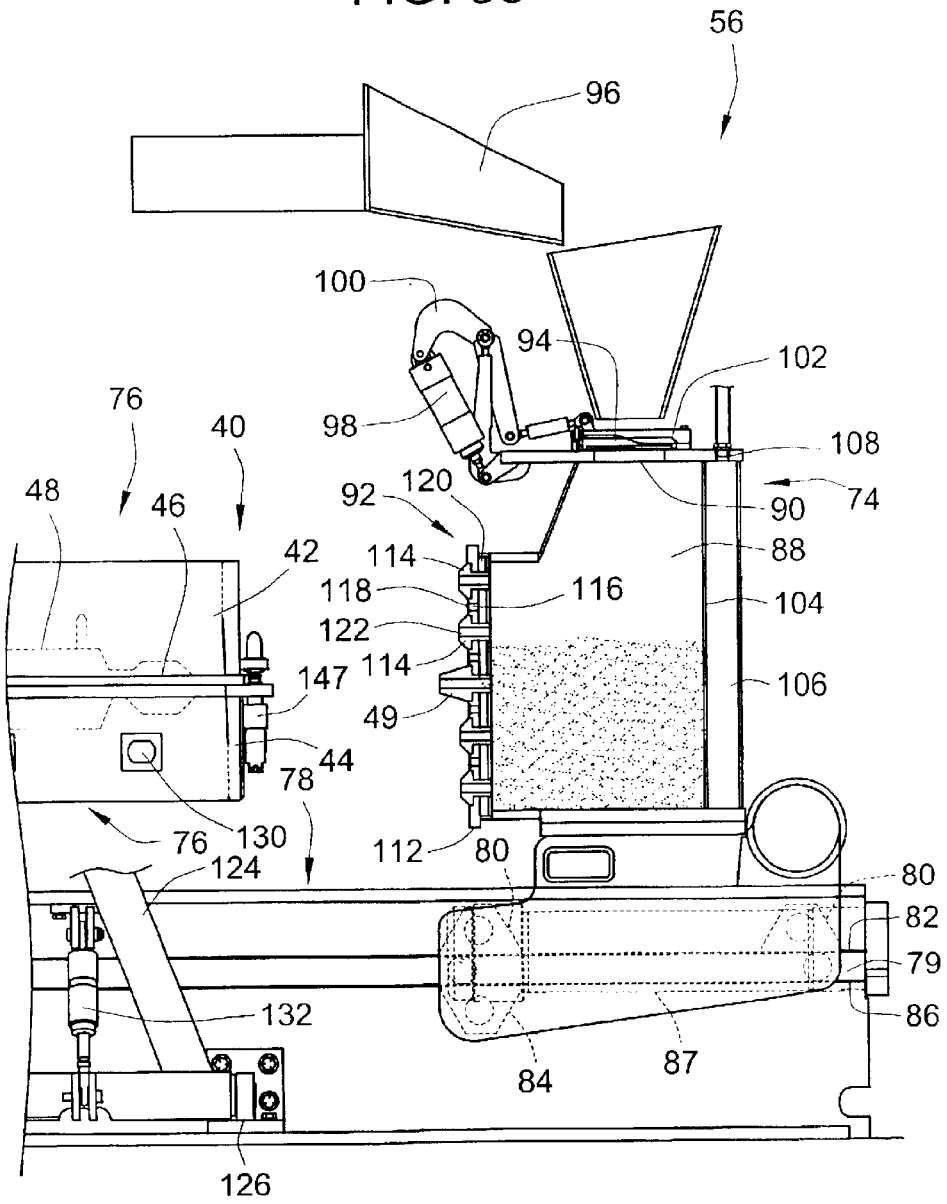

First, turning to the mold forming station 56, the sequence of operations are shown sequentially in FIGS. 29–38 in partial schematic form. Referring to FIGS. 29–30, an empty but assembled flask 40 is first indexed into the mold forming station 56 through rotation of the turret 60 (which simultaneously transfers the other mold flask to the draw station 58). Because draw operations usually take longer than mold forming operation, the sand magazines 74 typically will already be reloaded and full of sand in preparation for the next pneumatic blow operation. If not, then sand may continued to be metered into the sand magazines 74 via the vibrating conveyor 96 until a predetermined amount of sand is present in the sand magazines 74 sufficient to fill the empty mold flask assembly 40 with enough sand to form a sand mold 22.

Figure 31:
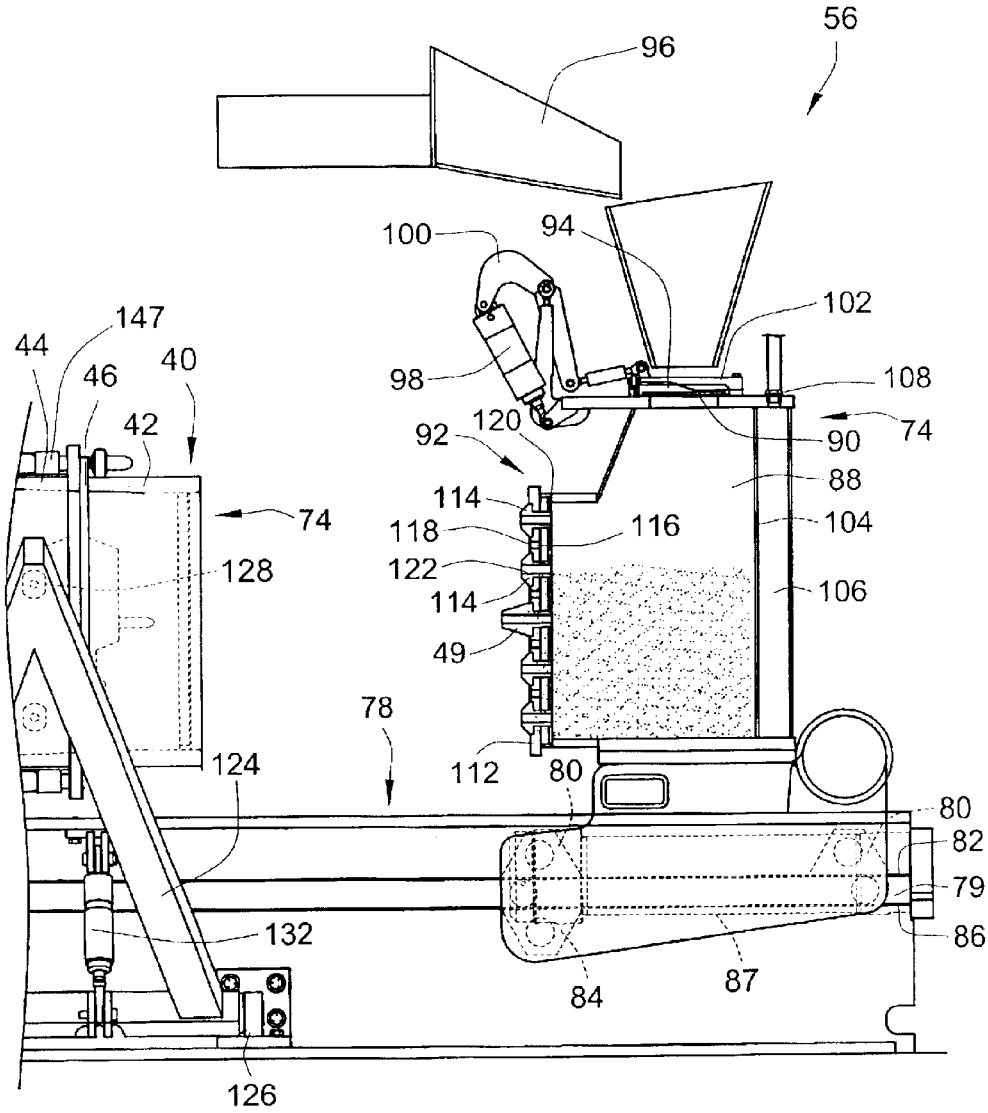

Once the empty flask assembly 40 is indexed into position, it is then rotated from the upright position shown in FIG. 30 to the turned or fill position shown in FIG. 31. The clamping screws 147 secure the cope flask 42 to the drag flask 44 with the bolster and matchplate sandwiched therebetween to prevent the cope flask 42 from falling off under the force of gravity. Because the sand magazine 74 has been filled or recharged with sand, the gate 94 is actuated to close or seal off the inlet 90 leading to the sand magazine reservoir 88 as is also shown in FIG. 31.

Figure 32:
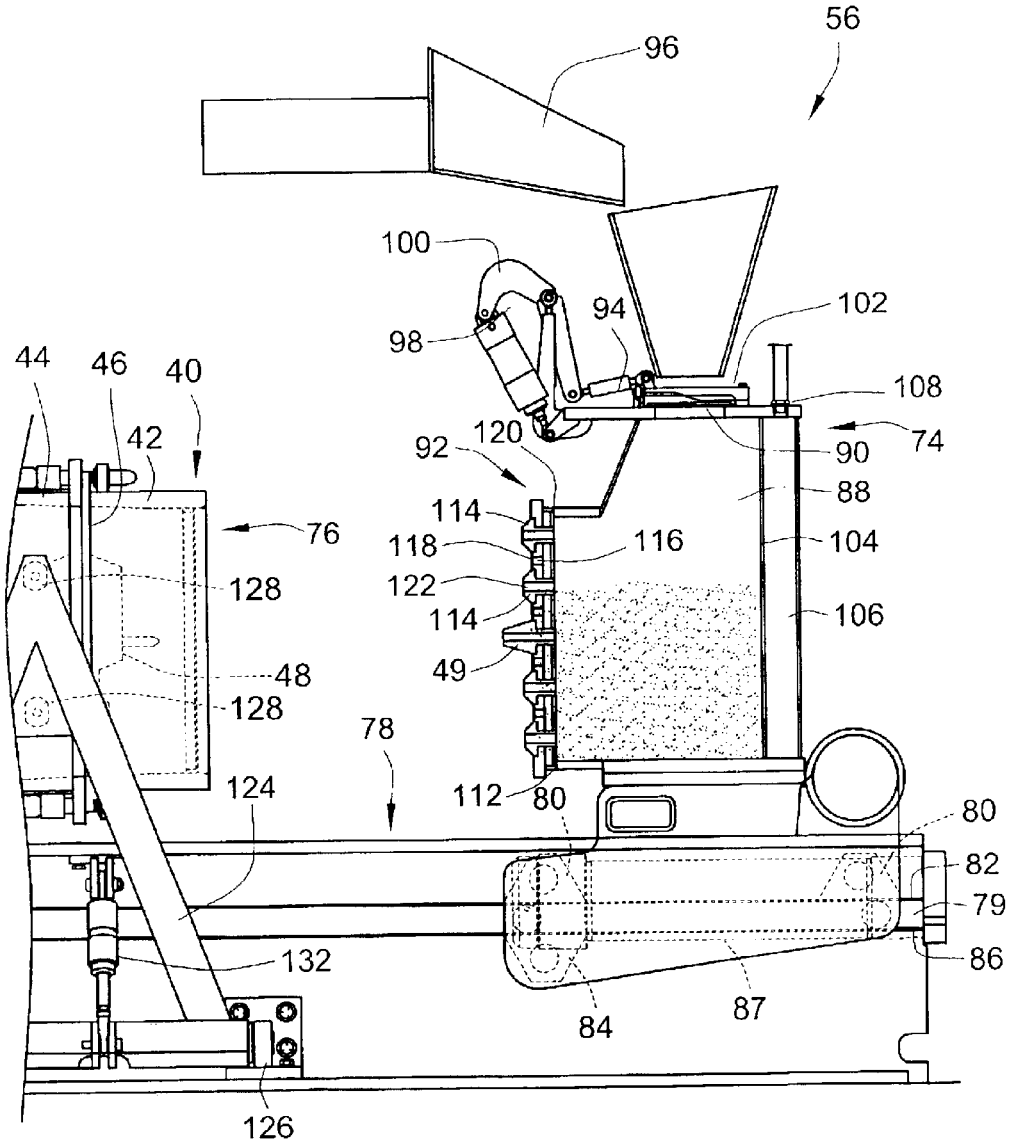

After the empty mold flask assembly 40 is rotated into the turned position, it is only supported by the turret 60 through the connecting arm 69 at this time (see FIGS. 8 and 9 also). To provide for further support of the mold flask assembly 40, the A-frame brace 124 is actuated to engage the opposing side of the drag flask 44 as shown in FIG. 32. The A-frame brace 124 prevents moment loads tending to rotate the turret 60 during blowing and squeeze operations if and when horizontal forces imparted by opposing sand magazines 74 are unequal.

With the brace 124 engaged and the flask assembly 40 now more fully supported, the sand magazines 74 are actuated inwardly toward each other to engage the opposing horizontally spaced open ends 76 (e.g. by penetrating the open ends 76) of the cope flask 42 and the drag flask 44. With additional reference to FIG. 40, the blowheads 92 of the sand magazines 74 slide into the open ends 76 closely against the straight wall portions 184 of the cope flask 42 and drag flask 44 to prevent escape of sand therebetween. The straight wall portions 184 are closely configured to the outer rectangular periphery of the squeeze board 112 to allow for close sliding insertion of the blowheads 92 into the open ends 76 of the cope and drag flasks 42, 44 to prevent sand from escaping during blowing operations while also allowing for further horizontal sliding movement to facilitate squeeze operations. Tapered surfaces 186 extend from the straight wall portions 184 along the cope and drag flasks 42, 44 to provide the resulting sand mold 22 with a generally trapezoidal shape for easy mold ram out.

Once the blowheads 92 have engaged the opposing ends 76 of cope and drag flasks 42, 44, the pneumatic charge chamber 106 is pressurized via a high pressure compressed air source and pressurized air flows through the baffle plate 104, as shown in FIG. 34. The pressurized air flowing through the baffle plate 104 fluidizes the sand contained in the sand magazine reservoirs 88 and conveys the fluidized sand into the cope and drag flasks 42, 44 through the nozzles 114. The pressurized air is vented once it enters the cope flask 42 or drag flask 44 through the vents 116 and out through the planar exhaust gap 120 between the blowhead 92 and the endplate 110 of the sand magazine 74. The screens 118 secured within the vents 116 allow for exhaust of the pressurized air but retain the sand in the mold flask assembly 40.

As can be observed in comparing FIGS. 33 and 34, during horizontal sand blowing operations, the nozzles 114 have a horizontal trajectory aimed at the matchplate 46 that is perpendicular to the vertical plane of the matchplate 46 in the turned/fill position. By blowing sand perpendicular to the matchplate and horizontally, the projecting pattern 48 does not have hidden sides or portions shielded from the trajectory of the nozzles 114 such that the cope and drag flasks 42, 44 are more completely filled with fewer air pockets or gaps that could otherwise cause defects in the metal casting process. Further, because the process is horizontal, the force of gravity need not be overcome to fill the drag flask 44 with sand.

Figure 35:
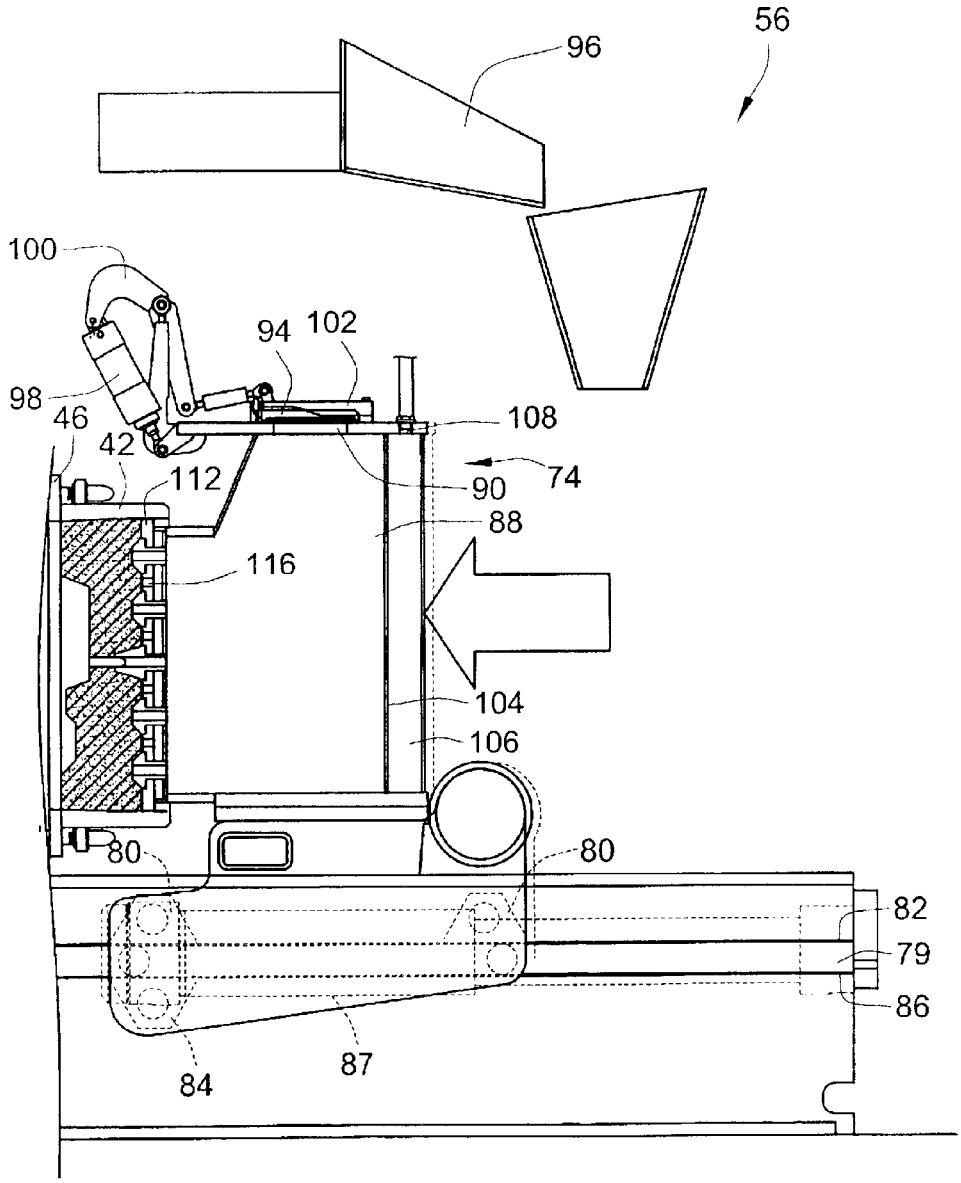

Once the cope and drag flasks 42, 44 are loosely filled with sand as shown in FIG. 34 and the blowing operation is complete, the sand magazines 74 are driven even closer together horizontally as schematically shown in FIG. 35 such that the squeeze boards 112 of the opposing sand magazines 74 compress and tightly pack the sand in the cope and drag flasks 42, 44. During this operation, horizontal forces can be carried through opposing sides of the drag flask 44 via the turret 60 through the connecting arm 69, as well as through the A-frame brace 124 that engages the opposing side of the drag flask 44. Because of the large horizontal force imparted by the hydraulic cylinders 87 to achieve a substantial squeezing force, the lower slippers 84 prevent moment loads from allowing the leading ends of the sand magazines from lifting vertically off the horizontal track 78.

Figure 36:
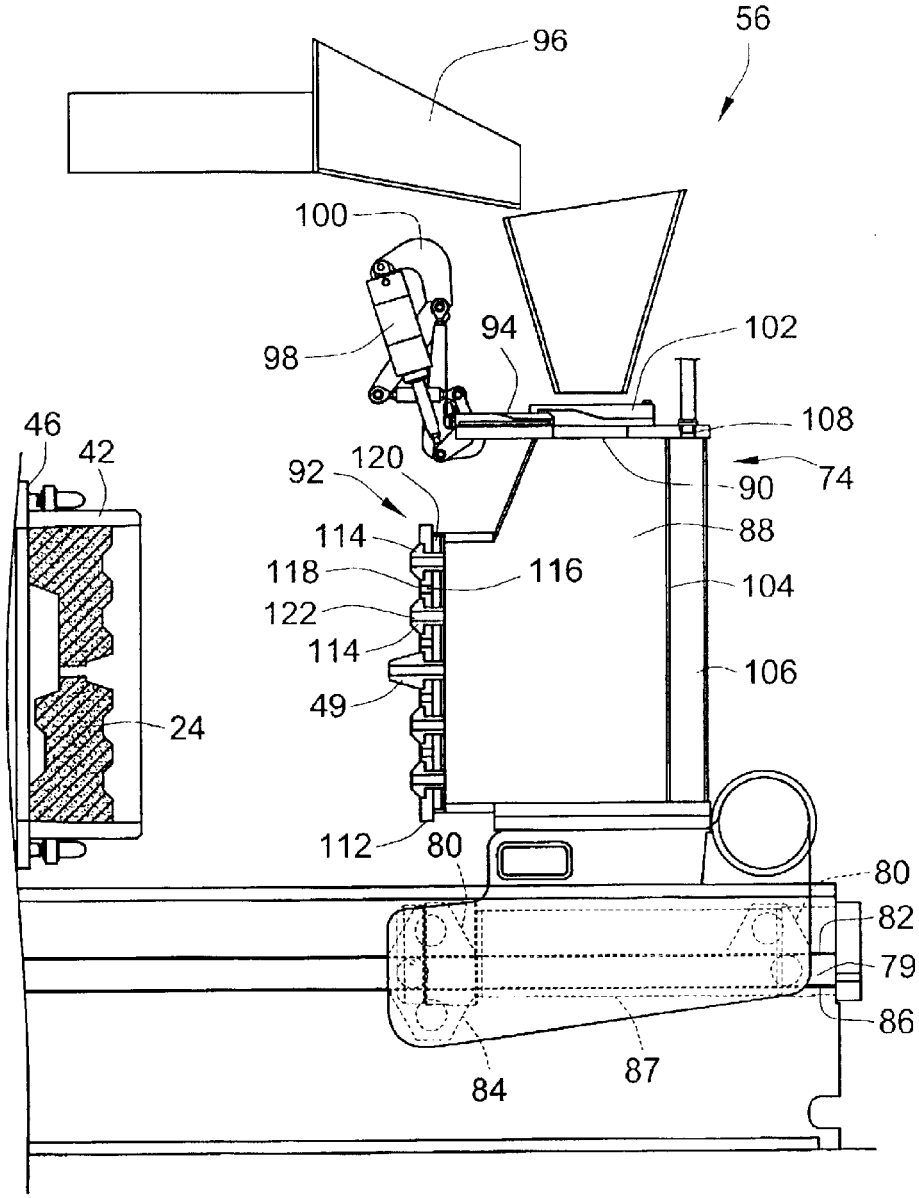
Figure 37:
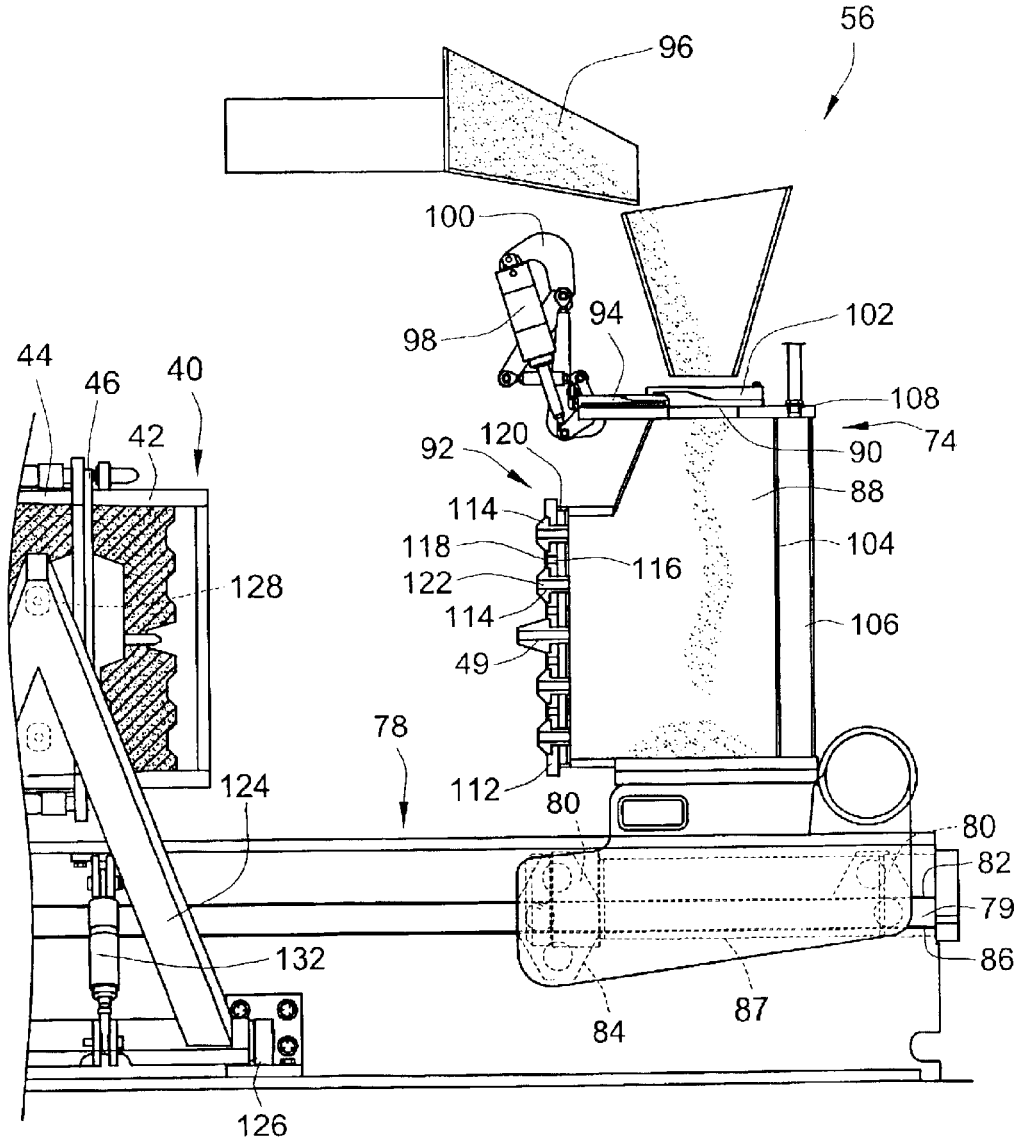

After the mold 22 is squeezed and compacted, the sand magazines 74 are retracted away from the mold flask assembly 40 as shown in FIG. 36 (and horizontally away from each other as shown in FIG. 2). Once each sand magazine 74 is fully retracted with the inlet 90 vertically aligned with the feed outlet of the overhead vibrating conveyor 96, the inlet gate 94 opens and sand can be metered into the sand magazines 74 as shown in FIG. 37 to refill or reload the sand magazines for the next cycle. A sensor (not shown) mounted through the wall of the magazine 74 may be used to sense sand level in the magazine to indicate when the sand magazine is sufficiently refilled. During or about the same time, the brace 124 disengages the drag flask 44 and pivots out of the way to release the drag flask 44 and provide clearance for the next indexing of the turret 60.

Figure 38:
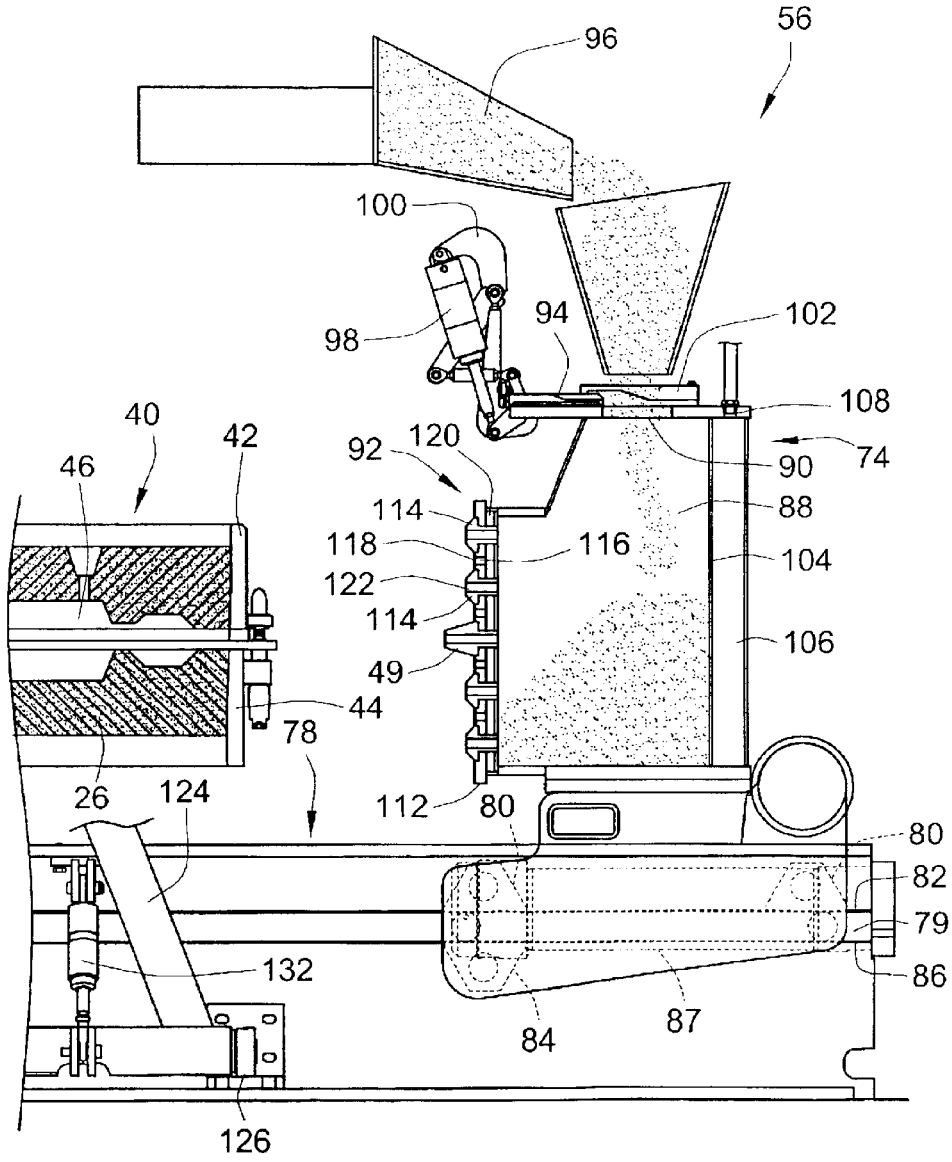

Once the drag flask 44 is released, the entire flask assembly 40 is rotated back to the upright position as shown in FIG. 38. It is noted that the drag flask 44 does not include an underside support to support the now formed drag mold 26. Instead, the compactness of the sand in the drag mold 26 keeps the drag mold 26 suspended in the drag flask 44. To further ensure that the drag mold 26 is secured in the drag flask 44 when the flask assembly is upright, and with reference to FIG. 40, the inner tapered surface 186 of the drag flask has been reduced to 2° relative to perpendicular, or other appropriate inclined angle that may be less than 4° as is common in prior molding machines flasks. The drag flask 44 is normally formed of steel that inherently has a low friction coefficient. The inner surface of the flask assembly 40 may also be coated with a friction increasing coating material such as a polyurethane coating 188 which inhibits vertical sliding of sand molds in the drag flask 44. The coating 188 and reduced angle of the inner tapered surface 186 each provide a means to further prevent molds from accidentally falling out the open bottom of the drag flask 44 when in the upright position shown in FIG. 38. Once the mold flask assembly 40 is rotated to the upright position shown in FIG. 38, it is ready to be indexed back to the draw station for disassembly of the mold flask and ram out of the cope and drag molds 24, 26.

With the mold flask 40 rotated back upright as shown in FIG. 30, it is ready to be rotated back to the draw station 58 via the turret 60. As such, attention will now be directed toward the draw station 58 at the front half of the machine 20 and specifically FIGS. 14–28 which sequentially illustrate the various operations performed at the draw station 58.

Figure 15:
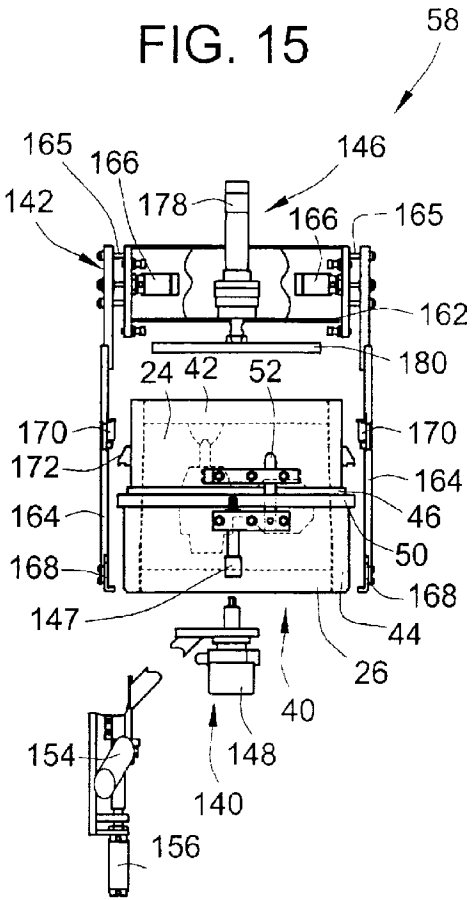
Figure 14:
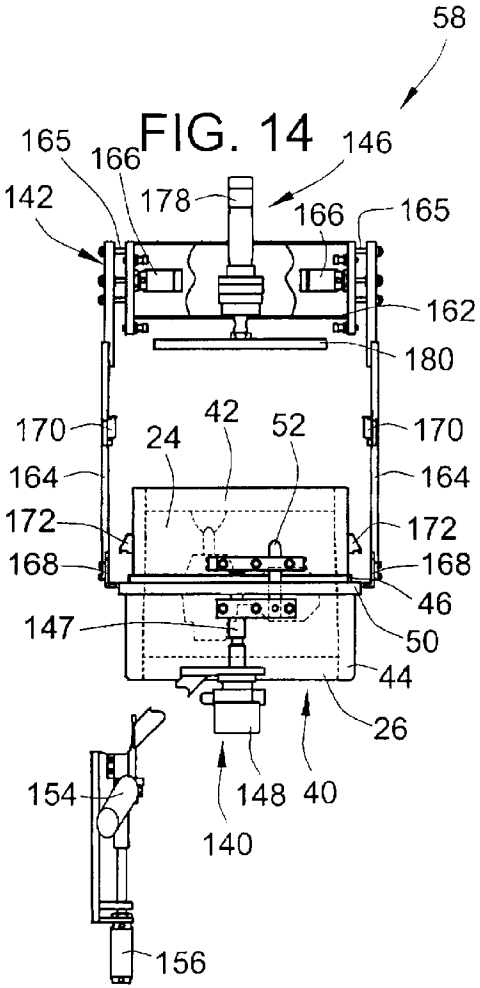

Referring to FIG. 14, when a mold flask assembly 40 filled with a cope mold 24 and drag mold 26 is received at the draw station 58, the cope flask 42 is clamped and threadingly fastened to the drag flask 44. In order to disassemble the flask assembly 40 to allow for removal of the cope and drag molds 24, 26, the clamping screws 147 are unfastened. As such, the first step occurring at the draw station 58 is that the screwdrivers 148 pivot or swing into vertical alignment with the respective clamping screws 147 under the actuation of the pneumatic cylinders 154 as shown in FIG. 14. The screwdrivers 148 are then driven vertically to engage and unfasten the clamping screws 147 as shown in FIGS. 14 and 15.

About or at the same time in which the screw unfastening operation is occurring, the draw carriage 142 (which was previously elevated to provide rotational clearance for rotation of the turret 60 and entry of a filled mold flask) that carries the draw hooks 164 is lowered vertically into a ready pick position as is shown in FIG. 16. During carriage lowering, the front and rear pairs of the draw hooks 164 are actuated via cylinders 166 to an expanded position such that the draw hooks 164 do not engage the mold flask assembly 40 as the draw hooks 164 are lowered.

Figure 19:
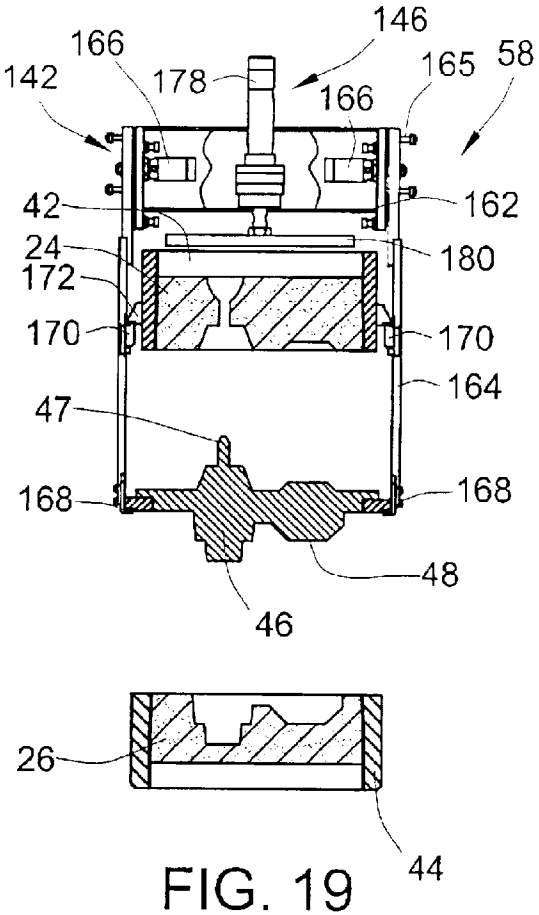
Figure 18:
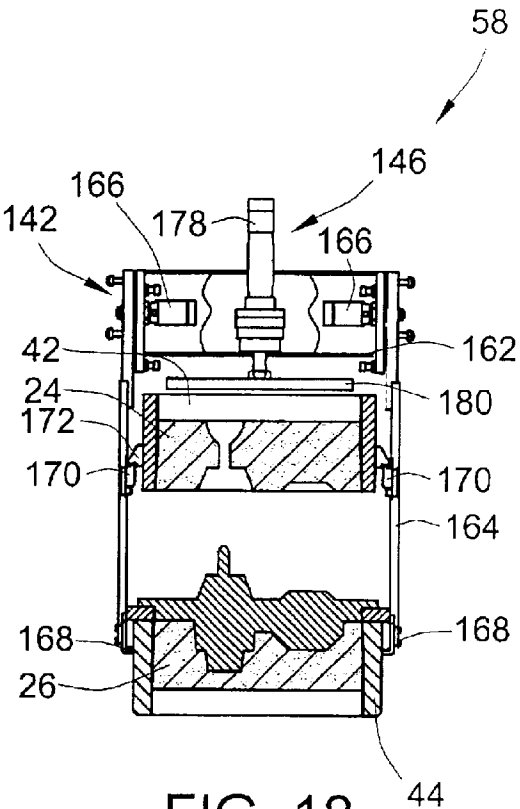

Once the lift detents 170 are positioned under the corresponding detents 172 on the cope flask 42, the draw hooks 164 are actuated inward toward each other to engage the detents 172 on the cope flask 42 as shown in FIG. 17. With the cope flask 42 now unclamped from the drag flask 44, the draw carriage 142 is lifted to first lift the cope flask 42 off the matchplate 46 as shown in FIG. 18. Continued upward movement of the draw carriage 142 causes the lower lift tabs 168 to then engage the bottom side of the support bolster 50 to lift the support bolster 50 and matchplate 46 off of the drag flask 44 as shown in FIG. 18. As shown in FIGS. 17–19, this sequence of operation spaces the cope flask 42 from the matchplate 46.

Figures 20, 21, 22:
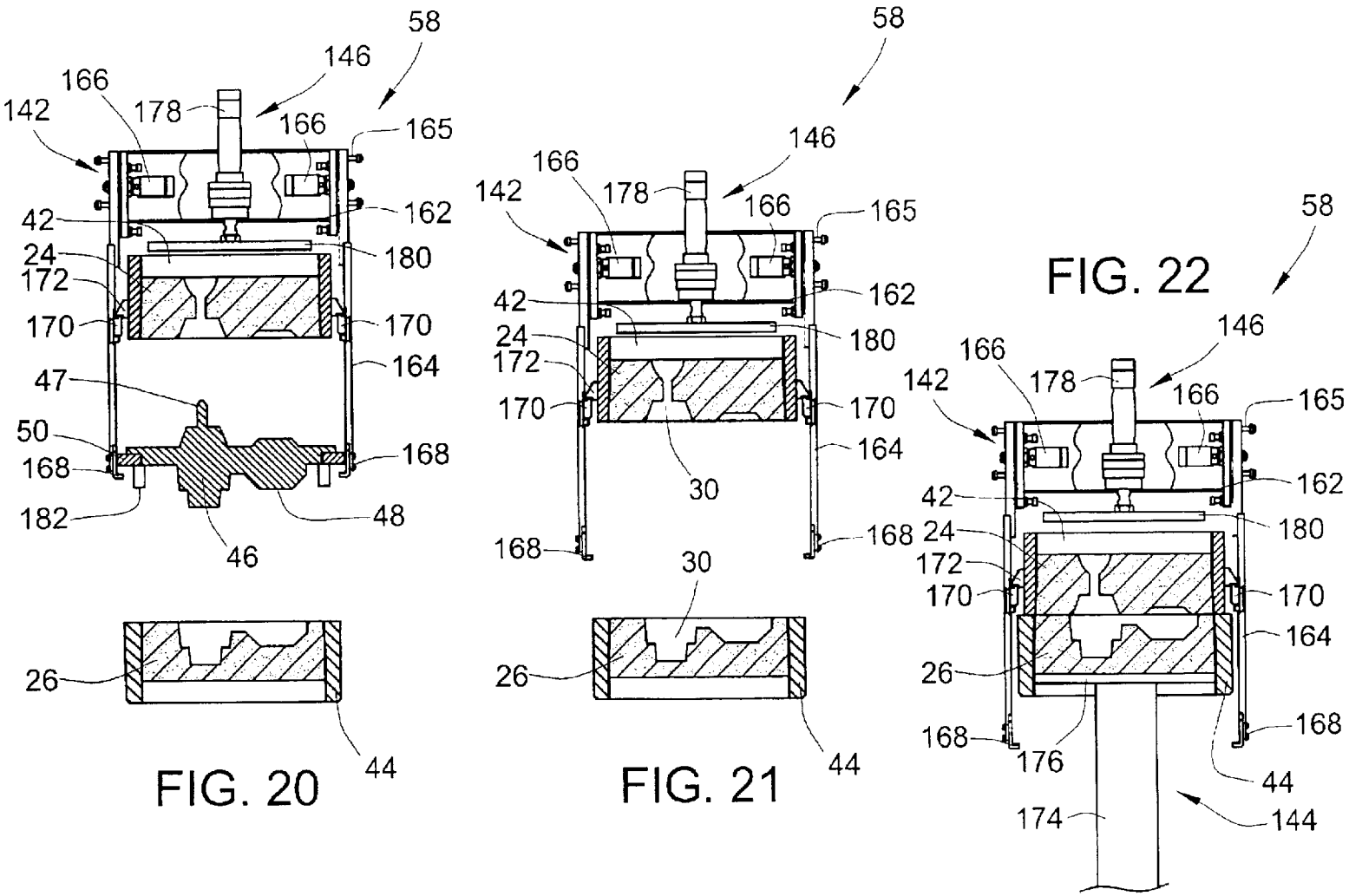

Once the carriage 142 is fully elevated, the suspension system 182 is maneuvered under the support bolster 50 and matchplate 46 and the carriage 142 is lowered slightly to place the support bolster 50 and matchplate 46 on the suspension system 182 as shown in FIG. 20. The suspension system 182 can then remove the matchplate 46 and bolster 50 and if desired to return the matchplate 46 to the storage rack 134 or switch the matchplate with a different matchplate stored in the storage rack 134. With the matchplate 46 and bolster 50 temporarily removed as shown in FIG. 21, the internal cavity 30 in the cope mold 24 and the drag mold 26 can be manually inspected, and if desired sand cores may be set into the drag mold 26. During or about the same time, the lower hydraulic ram 144 is expanded to locate the mold base platform 176 up into the drag flask 44 to a support position in which the mold base platform 176 is just under the drag mold 26 as shown in FIG. 22.

Figure 23:
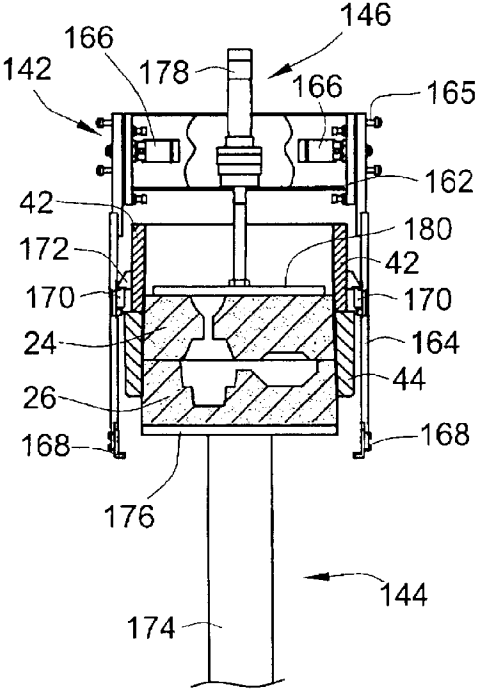

At this point, the draw carriage 142 is lowered again to place the cope flask 42 directly on the drag flask 44 without a matchplate or bolster therebetween. The upper hydraulic ram 146 is also lowered along with the draw carriage 142. Once the cope flask 42 is located on the drag flask 44, the upper hydraulic ram 146 is actuated further to push out the cope flask 24 and drag flask 26 through the bottom open end of the drag flask 26 as shown in FIG. 23. The lower ram 144 moves simultaneously with the upper ram 146 to support the formed sand mold 22 once it is ejected from the mold flasks 42, 44.

Once the sand mold 22 is rammed out, the lower ram 144 is lowered to place the sand mold 22 to a lower position where it can be pushed out the output station for further processing to create metal castings as shown in FIG. 24.

Figure 25:
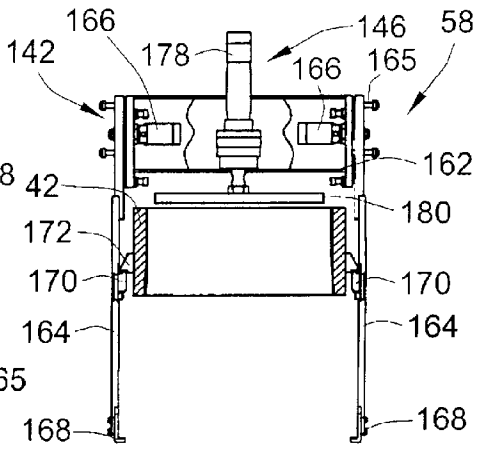
Figure 25:
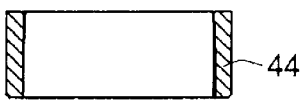
Figure 28:
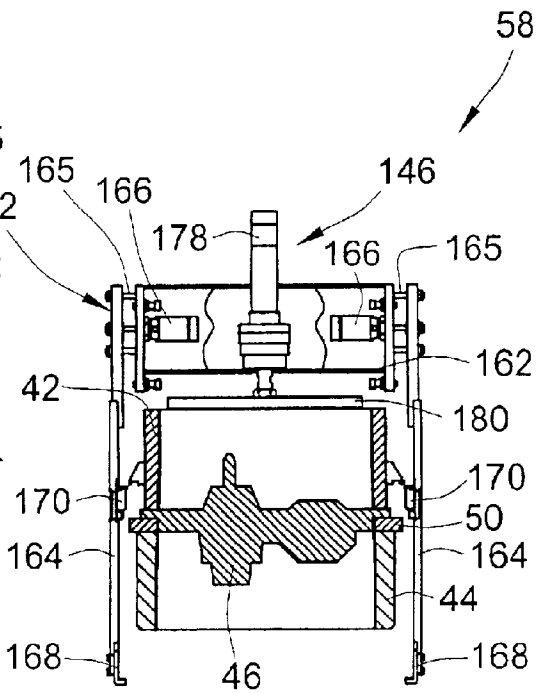
Figure 27:
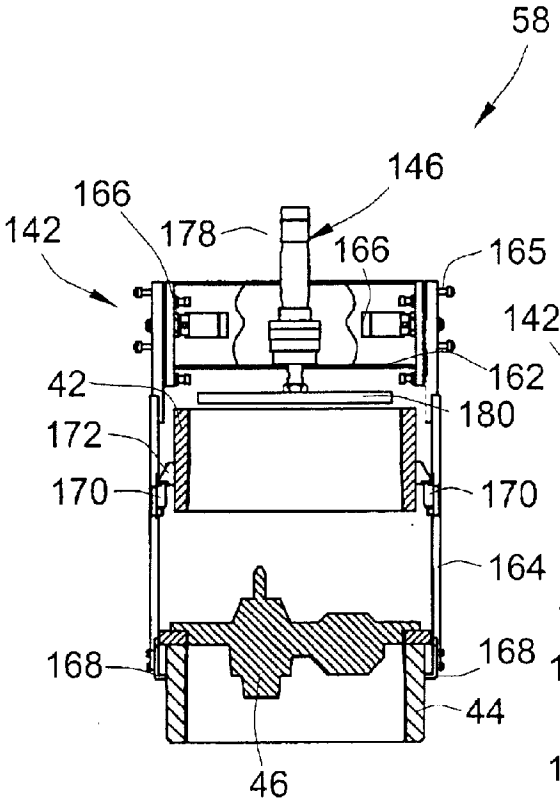
Figure 26:
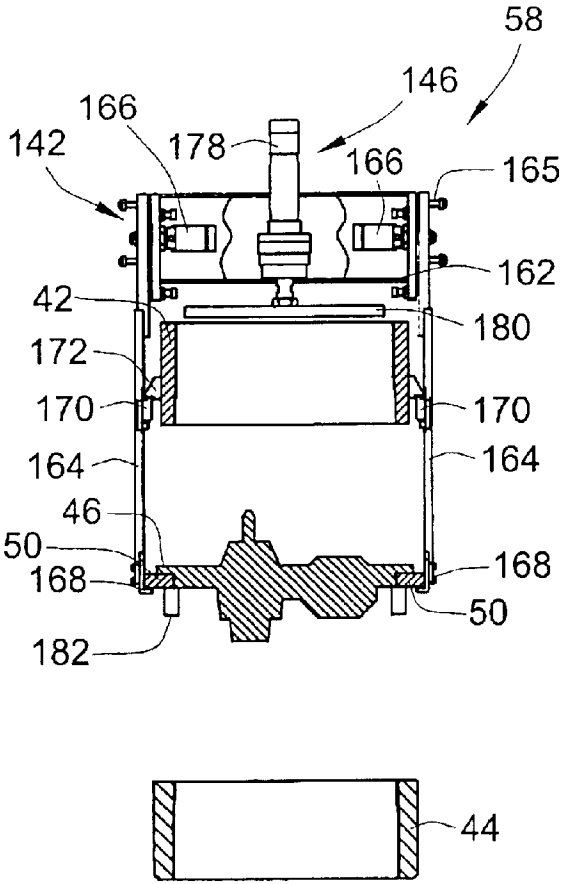

With the sand mold 22 gone and the flasks 42, 44 now empty, the mold flask assembly is again ready to be assembled. As such, the draw carriage 142 raises again to lift the cope flask 42 above the drag flask 44 as shown in FIG. 25. With vertical spacing between the flasks, a matchplate 46 and bolster 50 can then be placed on the lift tabs 168 as shown in FIG. 26. With the matchplate 46 and bolster 50 again in position, the draw carriage 142 is lowered a third time to place the support bolster 50 and matchplate 46 on the drag flask 44 (with the locating pins 52 being received through holes 54 in the bolster for alignment) and then shortly thereafter, the cope flask 42 on top of the support bolster 50 as shown in FIGS. 27 and 28. Locating holes 54 in the cope flask 42 also align the cope flask 42 on the support bolster 50 and drag flask 44.

With flask components now in position, the screwdriver 148 is again actuated but this time to screw the clamping screws 147 back into the cope flask 42 to securely fasten or clamp the cope flask 42 to the drag flask 44 with the bolster 50 and matchplate 46 securely sandwiched therebetween. At this point, the mold flask assembly 40 is fully assembled and empty, ready to be filled with a new sand mold. As such, the flask assembly 40 is now ready to be rotated and indexed back to the mold forming station 56. Once the draw carriage 142 is elevated out of the way and the screwdrivers 148 pivoted out of the way, the turret 60 is then again rotated to deliver the now empty mold flask to the mold forming station 56 and a now filled mold flask to the draw station 58. The sequence of steps illustrated in FIGS. 14–28 and 29–38 can then be repeated over and over again to successively create sand molds.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A matchplate molding machine, comprising:

a mold flask assembly comprising a cope flask, a drag flask and a matchplate between the cope and drag flasks, the matchplate having a pattern for forming a cavity in a sand mold;

a pair of horizontally spaced sand magazines having a blow heads adapted to fill the cope flask and the drag flask with sand horizontally, the sand magazines having a fill position wherein the flask assembly is horizontally between the sand magazines; and wherein a vertically extending parting line exists between the drag flask and the cope flask in the fill position, with the cope flask and drag flask disposed horizontally adjacent.

2. The matchplate molding machine of claim 1 further comprising a mold forming station having said sand magazines for forming the mold and a draw station adapted to dissemble the mold flask assembly and remove formed molds from the mold flask assembly, the mold flask assembly being cycled through the mold forming station and the draw station, wherein the flask assembly includes a draw position at the draw station and a fill position at the mold forming station, the flask assembly having a horizontally extending parting line between the drag flask and the cope flask in the draw position.

3. The matchplate molding machine of claim 2 further comprising:

a turret carrying a pair of said mold flask assemblies, the turret being rotatable about a vertically extending axis, each mold flask assembly being rotatable on the turret for rotation about a horizontally extending axis;

a first actuator rotating the turret about the vertically extending axis to move the mold flask assemblies between the draw station and the mold forming station; and second actuators independently rotating each of the mold flask assemblies about the horizontal axis relative to the turret.

4. The matchplate molding machine of claim 3, further comprising a support brace engaging each mold flask assembly when in the fill position at the mold forming station at a location offset from the turret.

5. The matchplate molding machine of claim 4 wherein the support brace pivots relative to the mold flask assembly, further comprising an actuator pivoting the support brace into and out of engagement with the mold flask assembly.

6. The matchplate molding machine of claim 2 further comprising means incorporated into the mold flask assembly for preventing formed molds from falling out of the drag flask under the force of gravity when turned from the fill position to the draw position.

7. The matchplate molding machine of claim 2 further comprising at least one clamp securing the cope flask and the drag flask together with the pattern plate therebetween, such that when the mold flask assembly is positioned in the fill position, the mold flask assembly stays together.

8. The matchplate molding machine of claim 7 further comprising means at the draw station for clamping and unclamping said clamp to allow for assembly and disassembly of the mold flask assembly.

9. The matchplate molding machine of claim 1 wherein each of the sand magazines is movable relative to the mold flask assembly, further comprising a pair of hydraulic cylinders reciprocating the pair of sand magazines horizontally towards and away from each other, respectively.

10. The matchplate molding machine of claim 9 wherein the sand magazines are mounted on a horizontally extending track, each sand magazine including at least three slippers sliding on the track including at least two slippers sliding horizontally along a upward facing surface of the track and at least one slipper sliding horizontally along a downward facing surface of the track.

11. The matchplate molding machine of claim 10 wherein the track includes a pair of laterally spaced rails, wherein laterally spaced pairs of at least two upper slippers slide along an upper surface of the respective rails and at least one pair of lower slippers sliding along a lower surface of the respective rails, the hydraulic cylinders interposed laterally between the rails.

12. The matchplate molding machine of claim 1 wherein each sand magazine includes a blowhead for slidably engaging an open end of the mold flask assembly, the blowhead including a plurality of nozzles having a trajectory aimed perpendicularly relative to the matchplate when in the fill position and a plurality of vents among the nozzles, wherein sand is blown through the nozzles into the mold flask assembly and pressurized air used for blowing sand into the mold flask assembly is vented through the vents.

13. The matchplate molding machine of claim 12, wherein said nozzles include horizontal passages having means for retaining sand in the sand magazine without gates blocking the horizontal passages.

14. The matchplate molding machine of claim 12 wherein each blowhead comprises a squeeze board, further comprising at least one hydraulic actuator squeezing the squeeze boards of opposing sand magazines together to compress sand blown into the cope and drag flasks.

15. The matchplate molding machine of claim 2 wherein the draw station includes a draw carriage slidable vertically relative to the mold flask assembly, the draw carriage having a plurality of plurality of draw hooks, the draw hooks having first lift means for vertically lifting the cope flask off of the matchplate and second lift means for vertically lifting the matchplate off of the drag flask.

16. The matchplate molding machine of claim 15 further comprising front and back pairs of the draw hooks, the front and rear pairs of draw hooks being laterally movable forwardly and rearwardly relative to each other, further comprising actuators driving the front and rear pairs of draw hooks forwardly and rearward to expand and contract lateral spacing among the draw hooks.

17. The matchplate molding machine of claim 16 wherein the draw station further comprises an upper fluid powered ram and a lower fluid powered ram adapted to enter opposing open ends of the cope flask and the drag flask respectively, the upper fluid powered ram adapted to push molds out of the mold flask assembly onto the lower fluid powered ram, the lower fluid powered ram adapted to lower molds for exit from the matchplate molding machine.

18. A matchplate sand molding machine for making molds, comprising:

a pair of mold flask assemblies comprising a cope flask, a drag flask and a matchplate between the cope and drag flasks, the matchplate having a pattern for forming a cavity in a sand mold;

a sand molding forming station;

a mold draw station adjacent the sand mold forming station;

a turret between the sand mold forming station and the mold draw station, the turret being rotatable about a vertical axis, each mold flask assembly being rotatably mounted to the turret for rotation about horizontal axes;

a first actuator rotating the turret about the vertical axis to move the mold flask assemblies between the mold draw station and the sand mold forming station;

second actuators carried by the turret independently rotating the mold flask assemblies about first and second about horizontal axes;

a pair of horizontally spaced sand magazines movable horizontally relative to each other, the first and second sand magazines adapted to engage opposing ends of the cope flask and the drag flask to fill sand into the cope and drag flasks horizontally; and at least one third actuator driving the first and second sand magazines toward and away from each other.

19. The matchplate molding machine of claim 18, further comprising a support brace at the mold forming station, the brace having an engaged position supporting the mold flask assembly at the mold forming station and a disengaged position releasing the mold flask assembly at the mold forming station, further comprising an actuator moving the support brace between the engaged and disengaged positions.

20. The matchplate molding machine of claim 18 further comprising means incorporated into the mold flask assemblies for preventing formed molds from falling out of the drag flask under the force of gravity when the mold flask assemblies are rotated upright with vertically spaced open ends of the cope flask and drag flask.

21. The matchplate molding machine of claim 18 further comprising at least one clamp securing the cope flask and the drag flask together with the pattern plate therebetween, such that when the mold flask assembly is rotated, the mold flask assembly stays together.

22. The matchplate molding machine of claim 21 further comprising means at the draw station for clamping and unclamping said clamp for assembly and disassembly of the mold flask assembly.

23. The matchplate molding machine of claim 18 wherein the at least one third hydraulic actuator comprises a pair of hydraulic cylinders reciprocating the pair of sand magazines horizontally towards and away from each other, respectively.

24. The matchplate molding machine of claim 23 wherein the sand magazines slide upon on a horizontally extending track, each sand magazine including at least three slippers sliding on the track including at least two slippers sliding horizontally along a upward facing surface of the track and at least one slipper sliding horizontally along a downward facing surface of the track.

25. The matchplate molding machine of claim 24 wherein the track includes a pair of laterally spaced rails, wherein laterally spaced pairs of at least two upper slippers slide along an upper surface of the respective rails and at least one pair of lower slippers sliding along a lower surface of the respective rails, the hydraulic cylinders interposed laterally between the rails.

26. The matchplate molding machine of claim 18 wherein each sand magazine includes a blowhead for slidably engaging an open end of the mold flask assembly, the blowhead including a plurality of nozzles having a trajectory aimed generally perpendicular to the matchplate when the sand magazine slidably engages the open end and a plurality of vents among the nozzles, wherein sand is blown through the nozzles into the mold flask assembly and pressurized air used for blowing sand into the mold flask assembly is vented through the vents.

27. The matchplate molding machine of claim 26, wherein said nozzles include horizontal passages having means for retaining sand in the sand magazine without gates blocking the horizontal passages.

28. The matchplate molding machine of claim 26 wherein each blowhead further comprises a squeeze board, further comprising at least one hydraulic actuator squeezing the squeeze boards of the sand magazines together to compress sand blown into the cope and drag flasks.

29. The matchplate molding machine of claim 18 wherein the draw station includes a draw carriage slidable vertically relative to the mold flask assembly, the draw carriage having a plurality of plurality of draw hooks, the draw hooks having first lift means for vertically lifting the cope flask off of the matchplate and second lift means for vertically lifting the matchplate off of the drag flask.

30. The matchplate molding machine of claim 29 further comprising front and back pairs of the draw hooks, the front and rear pairs of draw hooks being laterally movable forwardly and rearwardly relative to each other, further comprising actuators driving the front and rear pairs of draw hooks forwardly and rearward to expand and contract lateral spacing among the draw hooks.

31. The matchplate molding machine of claim 30 wherein the draw station further comprises an upper fluid powered ram and a lower fluid powered ram adapted to enter opposing open ends of the cope flask and the drag flask respectively, the upper fluid powered ram adapted to push molds out of the mold flask assembly onto the lower fluid powered ram, the lower fluid powered ram adapted to lower molds for exit from the matchplate molding machine.

* * * * *